US005553649A

United States Patent [19]

Chisaka et al.

[11] Patent Number: 5,553,649

[45] Date of Patent: Sep. 10, 1996

[54] BLIND APPARATUS

[75] Inventors: Yukinori Chisaka; Masaki Daizen; Yutaka Okamura; Yukihiro Tajima; Mamoru Kataoka; Akira Sone; Kimihisa Nishino, all of Tokyo, Japan

[73] Assignee: Kabushiki Kaisha Nichibei, Tokyo, Japan

[21] Appl. No.: 269,457

[22] Filed: Jun. 30, 1994

[30] Foreign Application Priority Data

| | | | |
|---|---|---|---|
| Jul. 5, 1993 | [JP] | Japan | 5-191955 |
| Sep. 17, 1993 | [JP] | Japan | 5-254815 |
| Dec. 28, 1993 | [JP] | Japan | 5-075482 U |
| Jan. 31, 1994 | [JP] | Japan | 6-001270 U |
| Jan. 31, 1994 | [JP] | Japan | 6-029077 |
| Jan. 31, 1994 | [JP] | Japan | 6-029078 |
| Feb. 1, 1994 | [JP] | Japan | 6-001240 U |
| Feb. 24, 1994 | [JP] | Japan | 6-053078 |
| Mar. 15, 1994 | [JP] | Japan | 6-069969 |

[51] Int. Cl.[6] ..... E06B 9/30

[52] U.S. Cl. ..... 160/168.1; 160/176.1; 160/178.2

[58] Field of Search ..... 160/168.1 R, 176.1 R, 160/178.2 R, 172 R, 173 R, 178.1 R, 177 R, 107, 902

[56] References Cited

U.S. PATENT DOCUMENTS

| | | | |
|---|---|---|---|
| 3,633,646 | 1/1972 | Zilver | 160/176.1 R X |
| 4,456,049 | 6/1984 | Vecchiarelli | 160/176.1 R |
| 4,643,238 | 2/1987 | Tachikawa et al. | 160/168.1 R |
| 5,275,222 | 1/1994 | Jelic et al. | 160/178.2 R |

*Primary Examiner*—David M. Purol
*Attorney, Agent, or Firm*—Anderson Kill Olick & Oshinsky, P.C.

[57] ABSTRACT

A blind apparatus including head box, a bracket for mounting the blind apparatus on a window, a plurality of vertically spaced parallel slats supported by ladder cords connected to a rotary drum located in a head box, a tilter device for tilting the slats and including a tilter input shaft, a tilter for transmitting the rotation of the tilter input shaft to the rotary drum, and a hollow rotating operation rod coupled to the tilter input shaft, slat lifting cords, a stopper device disposed in the head box for restraining the lifting cords from moving, and a stopper releasing cord connected at its one end to the stopper and extended through the interior of the rotating operation rod and the grip at a free end of the operation rod.

12 Claims, 32 Drawing Sheets

BLIND APPARATUS

BACKGROUND OF THE INVENTION

1. Field of the Invention

The present invention relates to a blind apparatus which is suspended on a wall or the like of a room and which can be hoisted up or down arbitrarily. More particularly, the present invention relates to a horizontal type blind in which a plurality of slats are supported horizontally by means of a ladder cord hung from a head box at a distance between respective upper and lower slats and in which lifting cords fit to a bottom rail disposed at the bottommost of the slats are introduced upward through the slats and then introduced into the head box, the lifting cords being further introduced within the head box horizontally toward one end of the head box, and in which the slats are lifted up or down by pulling or loosening the lifting cords and turned by moving up or down vertical cords located before and after the aforementioned ladder cord.

2. Description of the Related Art

Horizontal type blind apparatuses of the aforementioned type have been widely used. The horizontal type blinds enable the user to lift up or down the slats and adjust the slat angle easily. It is also possible to suspend the slats at a desired height by fastening the lifting cords at a desired position by means of a stopper device.

Recently, a new type blind apparatus has been proposed. According to the proposed invention, a rotating operation rod for rotating the slats is disposed near one end of the head box, and one end of the lifting cord is passed through the rotating operation rod and introduced downward from the bottom thereof. The slats are rotated by means of the rotating operation rod and lifted up or down by means of the lifting cords.

An example of the invention has been disclosed in Japanese Utility Model Laid-Open No. 61-102797.

In the horizontal type blind apparatus of this type, a stopper device which holds the motion of the lifting cords is incorporated near one end of the head box in order to fasten the lifting cords at a desired position.

In the prior art, the following stopper devices for the blind apparatus have been proposed. According to Japanese Patent Laid-Open No. 58-27399, lifting cords which are capable of lifting up or down the slats are inserted through a hollow operation rod which is capable of changing the inclination angle of the slats, and a grip disposed at the lower end of the operation rod is provided with a locking metal piece which is capable of locking the lifting up or down of the lifting cords.

However, the conventional stopper devices for such blind apparatus have the following problems. That is, because the locking metal piece is provided on the grip, an operating load is applied to the operation rod when the slats are lifted up or down. Thus, it is necessary to provide an operation rod having a large diameter in order to obtain sufficient strength, thus the size of the operation unit increases.

To solve the aforementioned problem, according to Japanese Utility Model Laid-Open No. 3-35035, in a differential drum which is capable of transmitting the rotation of the operating handle disposed in the head box to a rotation shaft, a stopper device is incorporated which has a conical portion having a U-shaped cross section capable of holding the lifting up or down of by nipping the lifting cords in cooperation with the tapered portion of the differential drum, and the lifting cords introduced from the head box are inserted through the hollow operating handle and then led out of the bottom of the operating handle. Additionally, one end of a stopper releasing cord which is capable of releasing the fastening of the lifting cords is connected to the stopper. Regarding the connection of the stopper releasing cord to the stopper, one end of the stopper releasing cord is introduced from the bottom of the stopper into the conical portion and a knot is formed in order to contain the knot of the stopper releasing cord within the conical portion. The other end of the stopper releasing cord is inserted through the operating handle and introduced out from the bottom end of the operating handle. When it is desirable to lift up the slats, the lifting cords are pulled downward to release the stopper. When it is desirable to let down the slats, the stopper is released by pulling the stopper releasing cord downward.

However, because the differential drum includes the function for transmitting the rotation of the operating handle to the rotation shaft as well as a stopper, the internal space of the differential drum is increased and the size of the differential drum is increased. Thus, the play of the lifting cord is increased. Additionally, because the differential drum and the stopper rotate integrally or relatively to each other, the lifting cords are likely to be twined. Further, because the stopper cannot be assembled beforehand because of the construction reasons, the workability of the assembly is low.

Still further, because the knot formed in the stopper releasing cord is contained in the conical portion of the stopper, the diameter of the conical portion must be increased. Thus, the conical portion must be formed so as to have a U-shaped cross section. Thus, when the lifting cords are nipped between the stopper and the tapered portion, the lifting cords slip so that the cord cannot be nipped firmly. That is, there is a possibility that the stopper may not be activated. The aforementioned problem is the first problem of the blind apparatus of the prior art.

As a conventional blind apparatus for operating the blind apparatus of the aforementioned type, the following invention has been proposed. For example, according to Japanese Utility Model Laid-Open No. 3-35035, a stopper device which is capable of locking the lifting up or down of the lifting cords is provided within the head box. The lifting cords are inserted through the operation handle and connected to different positions of the lifting operation knob which is rotatable with the operation handle, so that the slats can be lifted up or down. The bottom end of the releasing cord which is capable of operating the stopper mechanism is inserted through the operation handle and connected to the releasing operation knob which is rotatable with the operation handle, so that the slats can be lifted up or down. When the releasing operation knob is pulled down, the stopper mechanism is released, so that the slats descend.

However, the aforementioned conventional blind apparatus has the following problems. That is, when the slats are rotated, if the operation handle is turned, the lifting operation knob and the releasing operation knob rotate integrally therewith. Thus, the lifting cords and the releasing cord are twined within the operation handle.

Japanese Utility Model Laid-Open No. 57-99094 has disclosed an example in which the lifting cords are prevented from being twined. Namely, the bottom ends of the lifting cords which droop from the stopper mechanism provided at the bottom of the rotating operation rod are inserted through respective insertion holes provided on the knob having the same number of insertion holes as the number of the lifting cords and then connected with each other. However, this system prevents the lifting cords introduced from the bottom end of the rotating operation rod from being twined, because the stopper mechanism is provided at the bottom end of the rotating operation rod. Thus, even if this system is utilized in an apparatus which includes a stopper mechanism within the head box, it is not possible to prevent the lifting cords from being twined within the operation handle. The aforementioned matter is the second problem of the conventional blind apparatus.

As another example of conventional blind apparatus, the following apparatus is available. For example, according to Japanese Patent Laid-Open No. 60-113823, a universal joint is utilized. In this construction, bifurcated pieces are provided on each end of a hollow driving shaft and a hollow driven shaft and both bifurcated pieces are pivotally connected by a hollow connecting piece. Both bifurcated pieces and the connecting piece are pivotally connected by fitting a protrusion of each connecting point of the connecting piece into a receiving hole formed at each connecting point of each bifurcated piece. Both bifurcated pieces and the connecting piece are pivotally connected so that the center lines of the aforementioned shafts and a line connecting the respective connecting points of the connecting piece and the bifurcated pieces pass through the center of the connecting piece.

However, the aforementioned conventional blind apparatus has the following problem. That is, because the driving shaft, the driven shaft, the bifurcated piece and the connecting piece are hollow, the bifurcated pieces are bent by a downward load applied to the operation rod, so that the protrusions of the connecting piece are disengaged from the receiving holes of the bifurcated pieces.

According to another example of conventional apparatus, a washer is attached to the tip of the protrusion of the connecting piece in order to prevent the protrusions of the connecting pieces from being disengaged from the receiving holes of the bifurcated pieces. However, because a washer must be attached to every protrusion, the work necessary for this treatment is very troublesome.

These points are the third problem of the conventional blind apparatus.

In the aforementioned known blind apparatus, the device which inclines all the slats all at once to adjust the light shielding is called a tilter.

The tilter of the conventional blind apparatus contains, for example, a worm gear for transmitting the rotation of the rotating operation rod to a transmission shaft and a worm wheel and some types of the apparatus contain the tilter which is provided within the head box located at the top end of the rotating operation rod. The lifting cord is inserted through the rotating operation rod.

However, the tilter of the conventional blind apparatus has the following problem. Namely, when the slats are rotated by rotating the rotating operation rod, if the slats are lifted halfway and the rotating operation rod with the lifting cord introduced from the bottom of the rotating operation rod being hung on a cord hanger is rotated, the lifting cord within the rotating operation rod is twined. For this reason, a repellant force which tries to untwine the lifting cord is caused so that the rotating shaft rotates. Thus, it is not possible to maintain the slats in a desired condition.

The smaller the gear ratio between the worm gear and the worm wheel is, the more excellent rotation transmission efficiency the tilter has. However, the tilter utilizes braking force which occurs between the worm gear and the worm wheel in order to prevent the rotation shaft from being forced to rotate due to the aforementioned repellant force and an external force applied to the slat. Thus, the actual gear ratio is set to a relatively high value. For this reason, it is necessary to rotate the rotating operation rod by five-six turns in order to tilt the slats by 180 degrees.

Although the aforementioned problem can be solved if the worm gear and the worm wheel are made of material which is difficult to slip, if they are made of such material, it is not possible to secure a smooth rotation when the rotating operation rod is rotated, so that the gear ratio increases. This is the fourth problem of the conventional blind apparatus.

As the rotating operation rod of the conventional blind apparatus, the following apparatus has been proposed. For example, according to Japanese Utility Model Laid-Open No. 56-70091, a safety device having a substantially T-shaped cross section, which has a disk shaped head at one end of the thread portion is fixed to the rotating operation rod and the grip and the lifting cords are wound around the safety devices.

According to Japanese Patent Laid-Open No. 61-56383, T-shaped hooks protrude at two positions which are located at a predetermined distance along the length of the rotating operation rod and the lifting cords are wound around the hooks.

However, the rotation operation bar of the conventional blind apparatus has the following problem. That is, in the apparatuses disclosed in Japanese Utility Model Laid-Open No. 56-70091 and Japanese Patent Laid-Open No. 61-56383, the lifting cords are only wound around the hook having a substantially T-shaped cross section, which protrudes sideways from the rotating operation rod or the grip. Thus, when the slats are blown by the wind or the rotating operation rod is rotated with the condition in which the blind apparatus is descended halfway and the lifting cord is wound around the hook, the lifting cord is unwound from the hook.

Generally, a pair of lifting cords are disposed near both ends of the blind apparatus. However, it is necessary to provide a large size blind apparatus with a further or more lifting cords which are located in the center of or near the center thereof.

In a blind apparatus which utilizes at least three or more lifting cords, as compared with lifting cords which pass near both ends of the slats, a larger load is applied to lifting cords which pass in the center of the slats by a bottom rail and slats.

Because the lifting cord stopper device which fastens the lifting cords to stop the blind fastens all the lifting cords with equal force, the lifting cords which are applied with the largest load and which pass in the center of the slats are likely to slip even when the stopper fastens the lifting cords, so that the lifting cord stopper device cannot fasten the lifting cords which pass near the center of the slats. As a result, when the slats are descended halfway, the center portions of the slats and the bottom rail droop so that the level condition of the slats and the bottom rail cannot be maintained.

This point is also one of the problems which must be solved about the blind apparatus.

The blind apparatuses of the aforementioned types are fixed to a wall or the like of a room through a bracket.

As a construction which utilizes such fixing, the following types are known.

In the head box of conventional blind apparatus, the respective edges of both sides are bent inward and the head box is mounted on brackets by hooking the edges of both sides on hooking pieces of the brackets. The head box contains a rotating drum to which one end of the ladder cord supporting the slats is connected so that the ladder cord can be wound or rewound, a tilter which transmits the rotation of the rotating operation rod to the rotating drum and mechanical parts such as a stopper capable of holding the motion of the lifting cords for lifting up or down the slats. When the respective components are fixed to the head box, the top portions thereof are in contact with the aforementioned edges of the head box.

However, the aforementioned conventional blind apparatuses have the following problem. Because the mechanical parts are in contact with some locations of the edge portions of the head box, the brackets must be mounted at positions which no mechanical parts are fit to. Thus, when brackets are mounted on a window frame or the like, it is necessary to set the mounting positions of the brackets so as to avoid an interference between the mechanical parts and the brackets.

Although, in a blind apparatus in which both edge portions of the head box are bent outward, the brackets can be attached freely to any positions of the head box without taking into account the positions of the mechanical parts, the edge portions of the head box protrude outward, so that the width of the bracket must be increased. Thus, the appearance of the head box is deteriorated. This is also one of the problems which must be solved in conventional blind apparatuses.

Still another type of conventional blind bracket is disclosed in Japanese Utility Model No. 60-22237. The blind bracket disclosed therein comprises a substantially L-shaped supporting frame fit to a window frame and an engaging member detachable from the supporting frame. In the supporting frame, a cut-out dented portion is formed at the bottom of the beginning end of its level portion and a upward facing dented portion is formed at the front end of the level portion. The engaging member is supported by a supporting frame so that the engaging member is movable back and forth. In the engaging member, an engaging protrusion is formed at a position which corresponds to the cut-out dented portion when the engaging member is inserted into the supporting frame completely, and a locking piece and a locking tongue are formed at a position which corresponds to the engaging dented portion.

When the engaging member is inserted into the supporting frame completely, the top edge of one side of the box (otherwise called head box) is nipped between the cut-out dented portion and the engaging protrusion and fixed. The top edge of the other side is nipped between the locking tongue and the locking piece, the locking tongue and the locking piece sliding beyond the top edge thereof, in order to hold the right/left movement of the head box. Additionally, the top edge of the other side is nipped between the locking tongue and the engaging dented portion in order to restrict the up/down motion of the head box, thereby fixing the head box to the brackets. By pulling the engaging member from the supporting frame by a predetermined distance, the engaging protrusion which supports the bottom of the top edge of one side of the head box is moved so that the top edge is released from being supported. The locking tongue goes beyond the top edge of the other side, so that seizing of the top edge in the right/left direction and in the upward direction is eliminated. Thus, the head box can be removed from the bracket.

However, as for the aforementioned conventional bracket for the blind apparatus, if the engaging member is pulled out from the supporting frame, the top edge of one side of the head box becomes unsupported, so that the head box drops from the brackets. Thus, to adjust the right/left position of the blind apparatus after the head box is mounted to the supporting frame, it is necessary to support the head box by hand or the like to stop the head box from dropping. For this reason, according to this invention, it is not possible to adjust the right/left position of the blind apparatus easily.

Depending on a case, it is requested to mount the blind apparatus of the aforementioned type in a narrow space, for example, between double sashes or between a sash and a Japanese sliding paper door. In such a case, because the distance between the inside and outside sashes is small, it is desirable to reduce the back-and-forth dimension of the head box and further it is desirable that the bracket does not protrude.

The bracket which can meet such a demand comprises a supporting member mounted on the top surface of the top mounting space and a locking member mounted horizontally rotatably with respect to the Supporting member. A locking portion which is locked on a locking protruded edge formed inside of the top edge of the groove type head box is formed on the locking member. By rotating the locking member by means of an operation lever formed integrally with the locking member, the head box is locked or released.

Japanese Patent Laid-Open No. 40-34054 has disclosed the following type of the device for fixing a blind apparatus or a curtain supporting frame. This device comprises a supporting frame in which protruding edges which direct inward are formed at the top ends on both side walls and a groove is formed between the protruding edges and a fixing device in which a circular rise-up entering the groove of the supporting frame is formed on both sides of a substrate, in which a protruding edge engaging with the bottom faces of both protruding edges of the supporting frame is formed on the ends, in which handles are provided in succession between both protruding edges and in which a nail hole is formed in the center thereof. The fixing device is nailed on the upper beam of a partition of a room, window or the like so that the device is freely rotatable. The bent pieces of the supporting frame are hooked on both protruding edges.

Japanese Patent Laid-Open No. 63-106893 has disclosed a blind apparatus fixing metal piece in which engaging edges are formed by bending inward the top edges of the groove type frame and the engaging edges of the frame are engaged therewith by rotating the lever to fix the frame, the fixing metal piece being constructed so that the engaging member which is engaged between the bottom of the frame and the engaging edge is supported so as to be rotatable and that a lever for rotating the engaging member is connected to the engaging member.

Further, Japanese Patent Laid-Open No. 63-173497 has disclosed a blind fixing metal piece in which engaging edges are formed by bending inward the top edges of a groove type frame and the engaging edges of the frame are engaged therewith by rotating the operation lever, the fixing metal piece being constructed so that a shaft from which the operation lever originates is supported on one end of the supporting member so as to be rotatable, the supporting member being provided with a locking portion for supporting one engaging edge of the frame, one side of the shaft being provided with a locking groove which is locked on the other engaging edge according to the rotation of the operation lever.

However, if a blind apparatus is mounted in a narrow space, for example, between a sash outside and a Japanese sliding paper door inside by means of the aforementioned bracket, the protrusion dimension of the front end of the operation lever is so large that a force for releasing engagement between the bracket and the head box is applied to the front end of the operation lever. For example, if a sliding paper door is opened, the operation lever is turned in the direction in which the head box is released, so that the blind may drop. This is also one of the problems which must be solved about conventional blind apparatus.

SUMMARY OF THE INVENTION

It is therefore a primary object of the present invention to provide an improved blind apparatus which can overcome the above-described problems of the known blind apparatuses.

More specifically, an object of the present invention is to provide a blind apparatus having an improved stopper device.

To this end, according to one aspect of the present invention, there is provided a blind apparatus comprising: a head box; a bracket having retaining portions for retaining both longitudinal side edges of the head box so as to enable mounting of the head box; a series of vertically spaced slats arranged substantially in parallel with one another and supported by ladder cords; a bottom rail under the series of slats; a rotary drum disposed inside the head box, each the ladder cords being connected to the rotary drum so as to be wound and rewound on and from the drum; a tilter input shaft extended downward from one end of the head box and rotatable to cause tilting of the slats; a tilter disposed in the head box, for transmitting the rotation of the tilter input shaft to the rotary drum; a hollow rotating operation rod coupled to the tilter input shaft through a universal joint; a hollow grip provided at the lower end of the rotating operation rod; lifting cords connected at their one ends to a bottom rail and extended through holes formed in the series of slats into the-head box and then extended through the interior of the rotating operation rod and the grip and then through the grip so as to emerge from the lower end of the grip; a stopper device disposed in the head box and capable of restraining the lifting cords from moving; a stopper releasing cord connected at its one end to the stopper and extended through the interior of the rotating operation rod and the grip; wherein the stopper device includes a stopper case fixed to the head box and opened at its upper end; a cord nozzle provided on one end of sad stopper case so as not be able to move in the longitudinal direction; a cord stopper provided on the stopper case in such a manner as to be able to move in the longitudinal direction relative to the stopper case but not to be able to rotate relative to the stopper case; and an urging spring for normally urging the code stopper towards the cord nozzle; wherein the cord stopper has: a bottom portion fitted to the stopper case and having a bore in which the lifting cords are extended; a conical end projected from the bottom portion and cooperating with the code nozzle in clamping therebetween the lifting cords so as t fix the lifting cords; the cord stopper further having a first insertion hole extending from the bottom portion to open in the outer peripheral surface portion near of the cord stopper near the end of the cord stopper, and second insertion hole provided at the radially outer side of the first insertion hole and penetrating the bottom portion, the stopper release cord being extended through the first insertion hole from the bottom portion to emerge from the outer peripheral surface portion and then extended through the second insertion hole so a to emerge from the bottom portion opposite to the end of the cord stopper so as to be fastened to the cord stopper.

Another object of the present invention is to provide a blind apparatus having an improved operating arrangement capable of preventing twining of lifting cords.

To this end, according to another aspect of the present invention, there is provided a blind apparatus wherein the grip is rotatable integrally with the rotating operation rod and movable up and down relative to the rotating operation rod by a predetermined amount, the grip having a bore through which the lifting cords are extended for movement up and down, a twining preventive ring being attached to the grip for vertical movement integrally with id grip and for rotation relative to the grip, whereby the stopper can be released by mans the stopper release cord as a result of rotation and relative movement of the grip.

Still another object of the present invention is to provide a blind apparatus having an improved operating arrangement which eliminates undesirable disengagement of the components and which can easily be assembled.

To this end, according to still another aspect of the present invention, there is provided a blind apparatus, wherein the universal joint includes: a first bifurcated piece having a pair of branches projecting axially from one end of the tilter input shaft so as to oppose to each other, each the branch having a first pin receiving hole; a second bifurcated piece having a pair of branches projecting axially from one end of the tilter input shaft so as to oppose to each other, each the branch having a second pin receiving hole; and a hollow interconnecting piece having connecting pins rotatably received in the first and second pin receiving holes so as to interconnect the tilter input shaft and the rotating operation rod such that the tilter input shaft and aid rotating operation rod are rotated as a unit with each other while changing the angle formed therebetween; wherein the connecting pins interconnecting aid tilter input shaft and the interconnecting piece are provided on their heads with protruding portions which protrude in the direction of axis of the interconnecting piece, the first pin-receiving holes in the tilter input shaft is conically shaped such that its radius progressively increase towards the outer side.

A further object of the present invention is to provide a blind apparatus having an improved tilter.

To this end, according to a further aspect of the present invention, there is provided a blind apparatus wherein the tilter has a torque adding device which poses additional rotational torque such that a grater torque is required for causing the tilter shaft to star to rotate than that required after the tilter shaft has been started to rotate.

A still further object of the present invention is to provide a blind apparatus having an improved rotating operation rod or a grip.

To this end, according to a still further aspect of the present invention, there is provided a blind apparatus wherein the rotating operating rod comprises a pair of hooks spaced from each other in the axial direction, each of the hooks being capable of holding a lifting cord wound thereon, each the hook including: a connecting portion which can be attached to aid rotating operation rod and a T-shaped protruding portion having two wing portions projecting laterally from the connecting portion; one of the two wing portions of the T-shaped protruding portion and the connecting portion form therebetween a groove-like clamping portion, the hooks being arranged such that their clamping portions oppose each other.

A yet further object of the present invention is to provide a blind apparatus employing three or more lifting cords, improved to prevent drooping of the slats at the mid portion of the blind apparatus so as to maintain all the slats correctly in horizontal posture.

To this end, according to a yet further aspect of the present invention, there is provided a blind apparatus, wherein at least three lifting cords are used, characterized in that the central lifting cord, after being introduced into the head box, turns around a guide roller to extend away from the stopper device and then turned around a turning roller so as to be introduced into the stopper device.

A yet further object of the present invention is to provide a blind apparatus having an improved mounting structure.

To this end, according to a yet further aspect of the present invention, there is provided a blind apparatus, wherein the upper end edges of side walls of the head box are bent inward to oppose each other so as to form a mounting surface, and the rotary drum and the stopper device are fixed in the head box by means of spacers such that the levels of the rotary drum and the stopper device are below the level of the lower end of the retaining portions of the bracket, the spacers being shaped in conformity with the configurations of the bent upper edges of the head box so that their upper ends may not contact with the retaining portions of the bracket.

A yet further object of the present invention is to provide a blind apparatus having an improved mounting bracket.

To this end, according to a yet further Aspect of the present invention, there is provided a blind apparatus, wherein the bracket comprises a supporting frame, a retainer member and an urging member, the supporting frame having a vertical portion by means of which the supporting frame is secured to a wall or the like and a horizontal portion which is connected to the vertical portion orthogonally thereto, the retaining portion including a retaining tab formed on the horizontal portion of the supporting frame and capable of retaining one side of the head box, and a retaining projection formed on the retainer member so as to retain the other side of the head box; the horizontal portion including retaining portions formed on the free end thereof, and supporting shelves for supporting the retainer member such that the retainer member is movable into and out of the supporting frame, the retainer member including a spring portion for normally urging the retainer member into the supporting frame, a retaining projection formed on the lower face of the retainer member, guide grooves for guiding the urging member when the urging member is moved into and out of the supporting frame, a retaining portion provided on ends of the guide grooves so as to restrict the movement of the urging member, and anchor tabs for restricting movement of the retainer member out of the supporting frame; the urging member including an operating portion operable to cause movement of the urging member, a sliding portions received in the guide grooves so as to slide along the guide grooves, a resiliently deflectable urging tab connected between the operating portion and the sliding part, and a retaining projection formed on a lower portion of the urging member and capable of being fitted in a space between the retaining portions of the supporting frame and the one side of the head box.

A yet further object of the present invention is to provide a blind apparatus which is suitable for mounting in a restricted space such as, for example, a space between two sashes of a double-sash arrangement.

To this end, according to a yet further aspect of the present invention, there is provided a blind apparatus wherein the bracket comprises: a rotary member having retaining portions on both lateral sides thereof; and a supporting member for rotatably supporting the rotary member such that the rotary member is rotatable within a horizontal plane between a retaining position where the retaining portions of the rotary member retain both side edges of aid head box and a release position where the retaining portions of the rotary member release the side edges of the head box, the supporting member being capable of being fixed in a restricted space between a pair of shield members which are movable between and open positions, the rotary member including an operating lever formed integrally therewith, for causing rotation of the rotary member within a horizontal plane relative to the supporting member, the operating lever being provided at its front end with a bent portion which abuts a side wall of the head box when the rotary member is in the head box retaining position and a release prevention portion which projects by an amount substantially the same as the amount of projection of the bent portion, at the leading side of the bent portion as viewed in the direction of rotation of the operating lever towards the head box retaining position, whereby undesirable rotation of the operation lever to the head box release position, due to eventual contact of the operating lever with one of the shield members during opening or closing of the shield member.

These and other objects, features and advantages of the present invention will become clear from the following description of the preferred embodiments.

DESCRIPTION OF THE PREFERRED EMBODIMENTS

Figure 1:
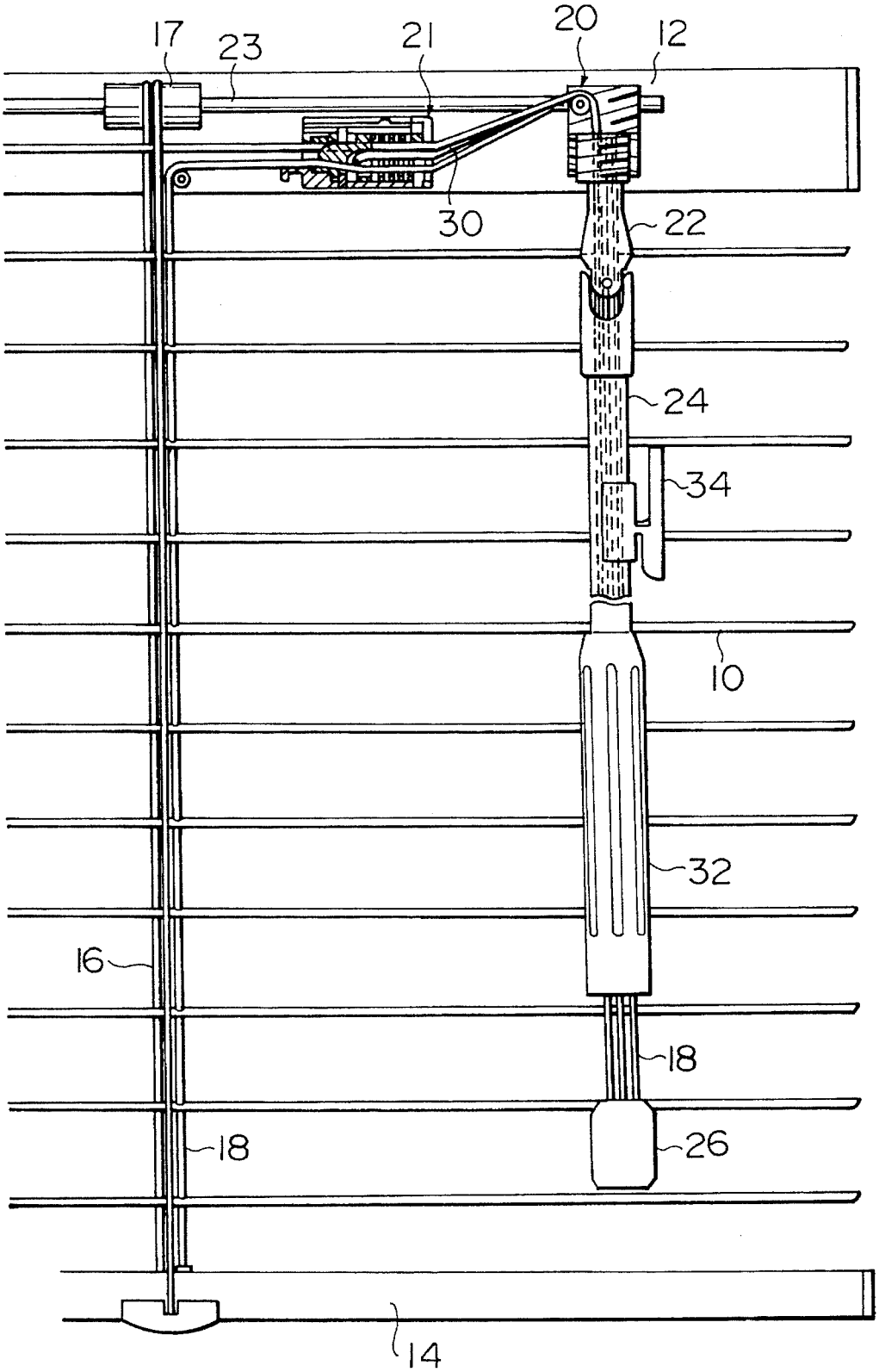
FIG. 1 is a drawing showing the blind apparatus which is an embodiment of the present invention.

FIG. 1 shows an embodiment of the blind apparatus of the present invention. In this blind apparatus, a plurality of slats 10 are arranged vertically at a predetermined distance. A head box 12 is disposed at the top end of ten rows of these slats and a bottom rail 14 is disposed at the bottom end. A ladder cord 16 is provided between the head box 12 and the bottom rail 14 to support the respective slats 10. The top end of the ladder cord 16 is connected to a rotating drum 17 which is rotatably provided within the head box 12 so that the ladder cord can be wound or released. The inclination angle of the slat 10 can be changed by the rotation of the rotating drum 17. A hollow tilter input shaft 22 is introduced from one end of the head box 12 and a hollow rotating operation rod 24 having a hollow grip 32 which is disposed at the bottom end thereof is rotatably connected to the bottom end of the tilter input shaft 22. The rotation of the rotating operation rod 24 is transmitted to a tilter 20 provided near one end of the head box 12 through the tilter input shaft 22. The rotation received by the tilter 20 rotates the rotating drum 17 which is connected to the rotating shaft 23 through the rotating shaft 23. One ends of the lifting cords 18 are connected to the bottom rail 14 and the other ends thereof are introduced into the head box 12 through insertion holes (not shown) which are provided on slats 10. The other ends thereof are passed through a stopper device 21 provided near one end of the head box 12, introduced through the tilter input shaft 22, the rotating operation rod 24 and the grip 32, and then are connected to the knob 26 which is disposed on the bottom of the grip 32 so that the lifting cords 18 can ascend or descend. As described later, the stopper device 21 is capable of holding the motion of the lifting cords 18. One end of a stopper releasing cord 30 which is capable of releasing the holding of the lifting cords 18 are connected to the stopper device 21. The other end of the-stopper releasing cord 30 is passed through the tilter input shaft 22 and the rotating operation rod 24, and then connected to the grip 32. The rotating operation rod 24 is provided with a cord hanger 34 on which the lifting cords 18 introduced from the bottom of the rotating operation rod 24 are hung.

Figure 2:
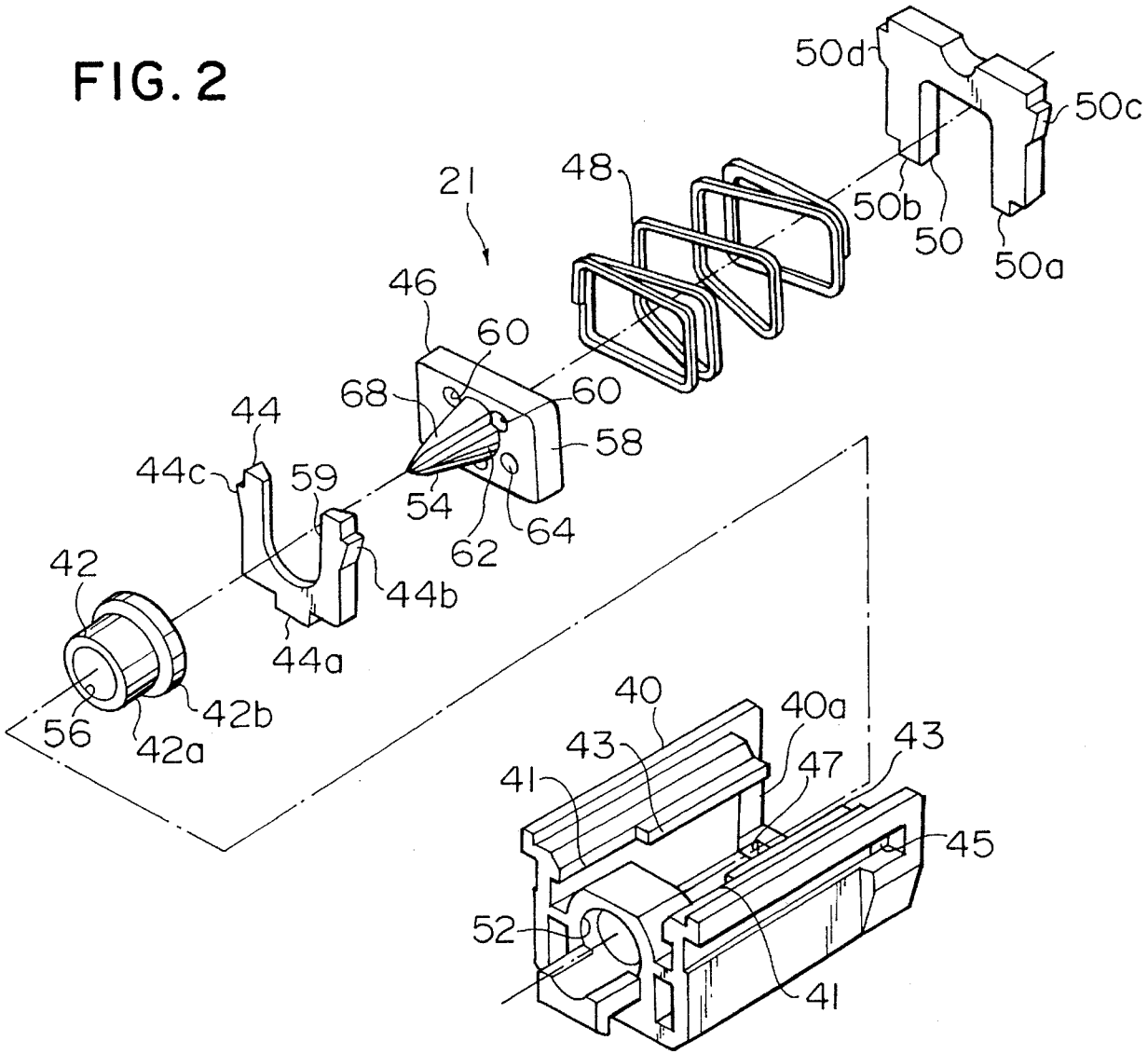
FIG. 2 is a disassembly perspective view of the stopper device.

FIG. 2 shows a disassembly perspective view of the stopper device 21. The stopper device 21 comprises a stopper case 40, a cord nozzle 42, a cord nozzle stopping member 44, a cord stopper 46, a spring (elastic body) 48, and a cord stopper blocking member 50.

The stopper case 40 is a substantially rectangular shape having an opening at the top. Protruded rails 41 are formed on the inside surface near the edge of both walls except near the right ends. Further protruded loosening preventive members 43 are formed on the protruded rails 41 from a predetermined position along the length of the rails 41 up to the right ends shown in FIG. 2. Engaging holes 45 are formed near the right ends of both walls, the engaging holes being near the protruded rails 41. Hole portions 47 are formed at two positions (one of them is not shown here) of the bottom of the stopper case 40 so that the holes 47 are on the same position along the length thereof. A cord nozzle supporting hole 52 for supporting the cord nozzle 42 is formed at the left end of the stopper case 40 as shown in FIG. 2.

The cord nozzle 42 comprises a small-diameter portion 42*a* which can be fit to the cord nozzle supporting hole of the stopper case 40 and a large-diameter portion 42*b*. The cord nozzle 42 has a nozzle hole 56 which allows the lifting cord 18 to pass therethrough and in which the cord stopper 46 is to be inserted to fasten the lifting cord 18.

A substantially U-shaped cutout portion 59 is formed in the cord nozzle stopping member 44. A protruding portion 44*a* which can be fit in a hole (not shown) formed on the bottom of the stopper case 40 is formed on the bottom of the cord nozzle stopping member 44. Protruding portions 44*b*, 44*c* which can engage with the protruded rails of the stopper case 40 are formed on both sides of the cord nozzle preventing member 44.

The cord stopper 46 comprises a substantially square pole bottom 58 and a conical end 54 which protrudes therefrom.

The cord stopper 46 has a plurality of lifting cord insertion holes which allow the lifting cords 18 to pass therethrough, the insertion hole being formed on the bottom of the cord stopper and disposed at a predetermined distance around the conical end. The cord stopper 46 contains a first insertion hole 62 (see FIG. 4) which is bored from the bottom 58 to the circumference of the conical end 54 and a second insertion hole 64 which is bored on the bottom near the first insertion hole 62 on the circumference of the conical end 54. The first insertion hole 62 and the second insertion hole 64 allow the stopper releasing cords 30 to pass therethrough. A guiding groove 68 for guiding the motion of the lifting cord is formed on the external surface of the conical end at a position corresponding to a lifting cord insertion hole 60 on the bottom 58.

A spring 48 is formed in the shape of a square and has almost the same size as the bottom 58 of the cord stopper 46.

The cord stopper blocking member 50 is formed in a substantially U-shape. The cord stopper blocking member 50 has protruding portions 50*a*, 50*b* which can engage with the hole portions 47 of the stopper case 40, the protruding portions being formed on the ends of both side walls, and it has protruding portions 50*c*, 50*d* which can engage with the engaging holes 45 of the stopper case, the protruding portions being formed on the sides of both walls.

The respective parts are formed of materials having a strength suitable therefor. As a result, the durability of the respective parts can be enhanced.

The assembly method of the stopper device will be described according to a perspective view of the stopper device shown in FIG. 3 and a sectional view thereof shown in FIG. 4.

First, the cord nozzle 42 is inserted from the top of the stopper case 40 and the small-diameter portion 42*a* of the cord nozzle 42 is fit to the cord nozzle supporting hole 52 of the stopper case 40.

Next, the cord nozzle stopping member 44 is inserted from the top of the stopper case 40 and the protruding portion 44*a* of the cord nozzle stopping member 44 is fit to the hole (not shown) on the bottom of the stopper case 40. The protruding portions 44*b*, 44*c* of the cord nozzle stopping member 44 are engaged with a groove disposed below the protruded rails 41 of the stopper case 40. Consequently, the large-diameter portion 42*b* of the cord nozzle 42 is nipped between the cord nozzle supporting hole 52 of the stopper case 40 and the cord nozzle stopping member 44 so as to fasten the cord nozzle 42.

Figure 3:
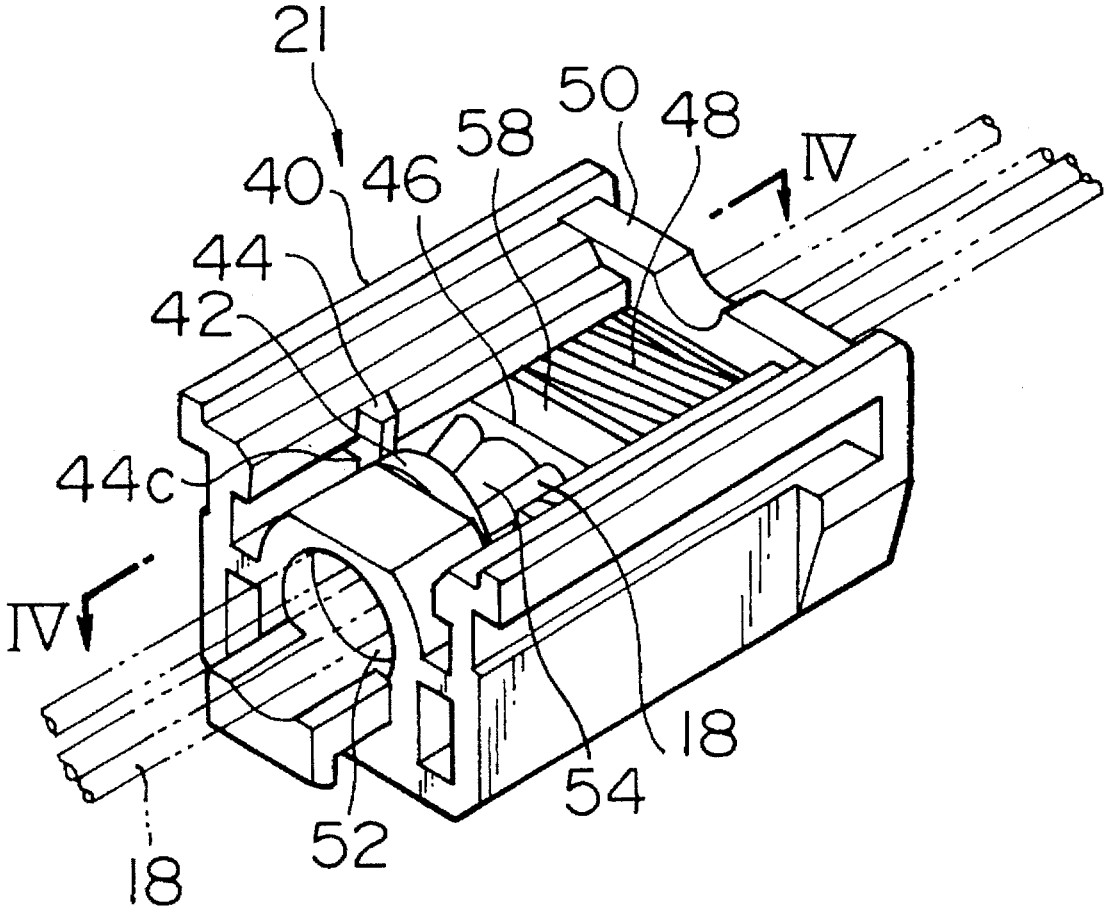
FIG. 3 is a perspective view of the stopper device.

Then, the cord stopper 46 is inserted from the right end shown in FIG. 3, of the stopper case 40. The cord stopper 46 is blocked from moving upward by means of the loosing preventive member 43, so that the cord stopper 46 does not slip out of the top of the stopper case 40. One end of the stopper releasing cord 30 is inserted from the bottom 58 through the first insertion hole 62 and introduced out of the circumference of the conical end 54. Then, the end of the stopper releasing cord 30 is introduced from the second insertion hole 64 to a side opposite to the side in which the conical end 54 of the bottom 58 is formed. Then, a knot (loosing preventive means) is formed to prevent the cord from being loose from the cord stopper 46.

The lifting cords 18 are introduced into the stopper case 40 through the cord nozzle supporting hole 52 of the stopper case 40 and inserted through the nozzle hole 56 of the cord nozzle 42 and then through the cutout portion 59 of the cord nozzle stopping member 44. Finally, the cords are introduced through the guiding groove 68 of the cord stopper 46 and led out of the lifting cord insertion hole 60.

Then, the cord stopper 46 is pressed to the left in the stopper case 40 so as to insert the conical end 54 into the nozzle hole 56 of the cord nozzle 42.

The spring 48 is inserted from the right end of the stopper case 40, as shown in FIG. 3, with the lifting cord and the stopper releasing cord 30 being inserted through the internal space of the spring 48.

Then, the cord stopper blocking member 50 is inserted from the top of the stopper case 40 with the lifting cord 18 and the stopper releasing cord 30 being inserted through the internal space of the cord stopper blocking member 50. The protruding portions 50*a*, 50*b* thereof are embedded into the hole portions 47 of the stopper case 40 and the protruding portions 50*c*, 50*d* thereof are engaged with the engaging holes 45 of the stopper case 40. Consequently, the spring 48 is prevented from loosing from the right end of the stopper case 40 by means of the cord stopper blocking member 50. At the same time, the cord stopper 46 is always pressed toward the cord nozzle 42. As a result, the conical end 54 of the cord stopper 46 is fit to the nozzle hole 56 of the cord nozzle 42 so that the lifting cord 18 is nipped therebetween. The lifting cords 18 are fastened by the cord stopper 46 due to a friction caused by engagement between the cord stopper 46 and the lifting cord 18, so that the lifting cord 18 is firmly held.

The operation of the present embodiment will be described below.

When it is desirable to lift up the slats 10, the knob 26 or the lifting cord 18 introduced from the bottom of the grip 32 is held and pulled downward. Then, the lifting cord 18 is guided by means of the guiding groove 68 of the cord stopper 46 and pulled to the right in FIG. 5. Due to friction caused between the lifting cord 18 and the cord stopper 46, the cord stopper 46 is slightly moved to the right in FIG. 5 resisting the elastic force of the spring 48. Consequently, the fastening between the nozzle hole 56 of the cord nozzle 42 and the conical end 54 of the cord stopper 46 is released thereby weakening the force of nipping the lifting cord between the nozzle hole 56 and the conical end 54, so that it is possible to further continue to pull down the lifting cord 18. Thus, the slats 10 can be lifted up.

Figure 5:
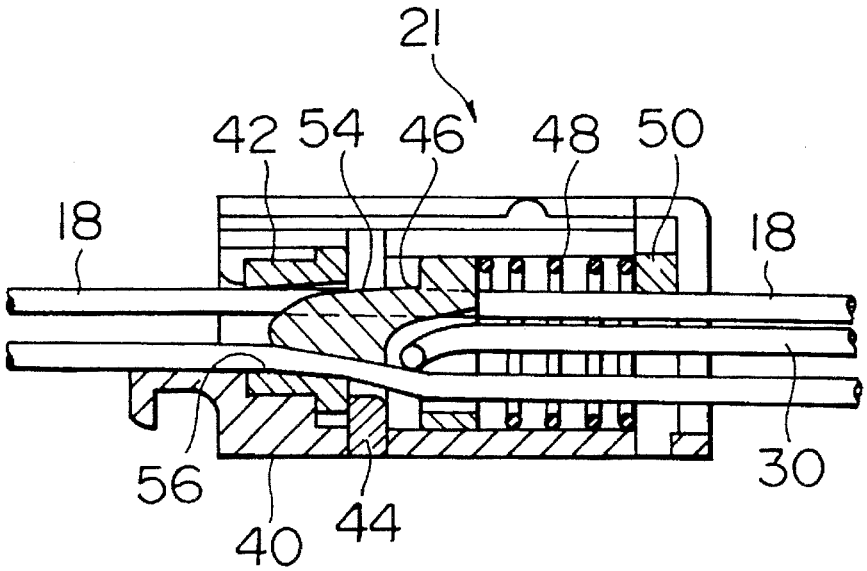
FIG. 5 is a drawing showing a stopper device in which a lifting cord is fastened.
Figure 6:
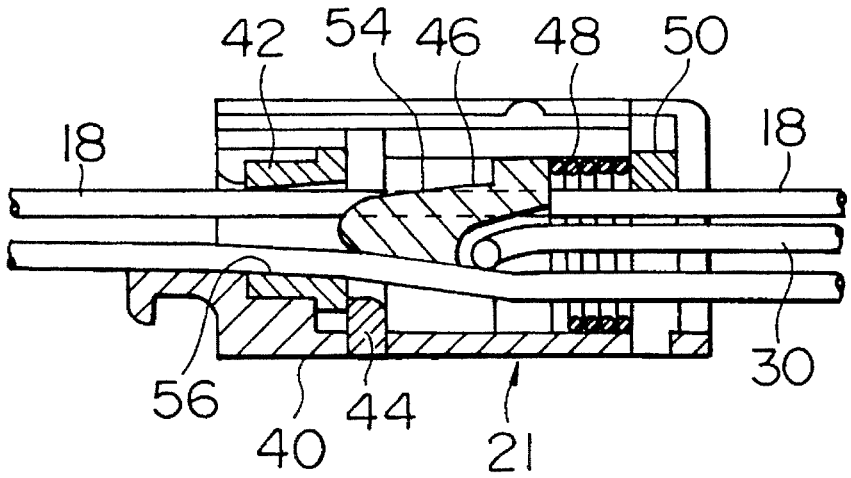
FIG. 6 is a drawing showing a stopper device in which fastening of the lifting cord is released.

When it is desirable to stop the slats 10 from being lifted up, the knob 26 or the lifting cord 18 is released from the hand. As a result, the force of pulling the lifting cord 18 to the right in FIG. 5 is released so that the cord stopper 46 is pressed to the cord nozzle 42 by means of the elastic force of the spring 48. Thus, the conical end 54 of the cord stopper 46 is fastened to the nozzle hole 56 of the cord nozzle 42 so that the lifting cord 18 is nipped therebetween. Due to friction caused by the engagement between the cord stopper 46 and the lifting cord 18, the cord stopper 46 fastens further the lifting cords 18, thereby blocking the lifting cords 18 from moving. As a result, it is possible to stop the slats 10 at a predetermined position.

In the aforementioned embodiment, the spring 48 is utilized as an elastic member. However, the elastic member is not restricted to the spring, but it is permissible to use other elastic member, for example, rubber.

According to the present invention, the stopper case which is open at the top is fixed to the head box and a cord stopper is fit to the stopper case so that the stopper cannot rotate relative to the stopper case but can move along the length thereof. A conical end capable of nipping the lifting cords between the conical end and the cord nozzle so that the lifting cords cannot be moved, is formed on the cord stopper and the stopper releasing cord is inserted from the bottom of the cord stopper through the conical end, and then introduced out of the external surface of the conical end. The lifting cord is introduced to a side opposite to the conical end and a loosening preventive knot is formed to connect the lifting cord to the cord stopper.

Thus, the stopper case and the cord stopper are both rotatable and the size of the stopper case can be decreased, thereby making it possible to decrease a space between the stopper case and the cord stopper. Then, it is possible to prevent the lifting cords from being twined. Additionally, it is possible to reduce the size of the stopper apparatus.

Because the top portion of the stopper case is open, parts can be assembled to the stopper case from the top. Because the assembly can be achieved by only fixing the stopper case to the head box, the assembly work is easy.

Because the loosening preventive knot of the stopper releasing cord is not contained within the conical end of the cord stopper, the diameter of the conical end can be reduced and the configuration of the conical end can be formed in a conical shape. Consequently, the lifting cords can be firmly nipped between the conical end of the cord stopper and the cord nozzle, and thus it is possible to actuate the stopper device securely.

Another embodiment of the present invention will be described with reference to FIGS. 7–9. This embodiment contains a grip having an improved construction. Because the entire construction of the blind apparatus is the same as described in FIGS. 1–6, the description thereof is omitted.

Figure 7:
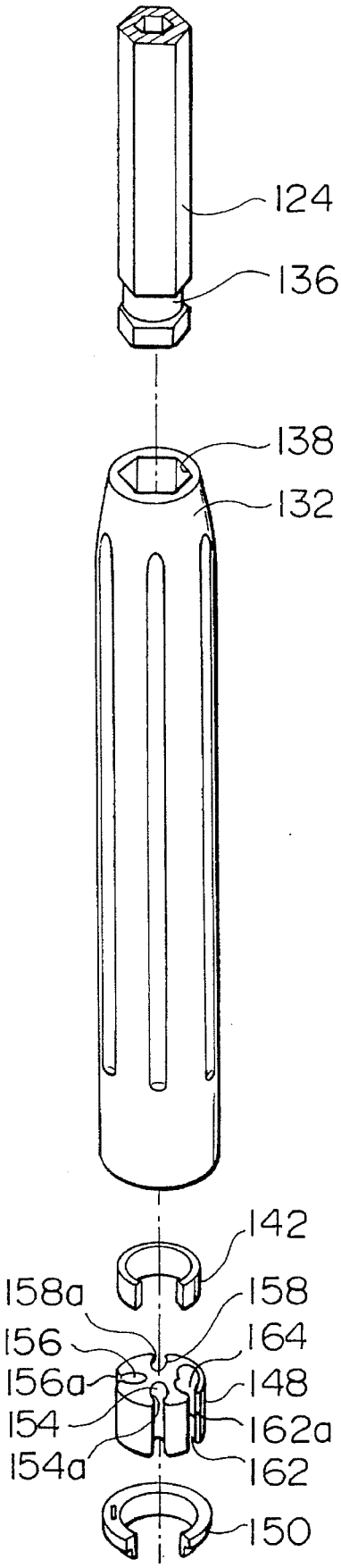
FIG. 7 is an exploded perspective view of a grip and parts therearound in a different embodiment.
Figure 8:
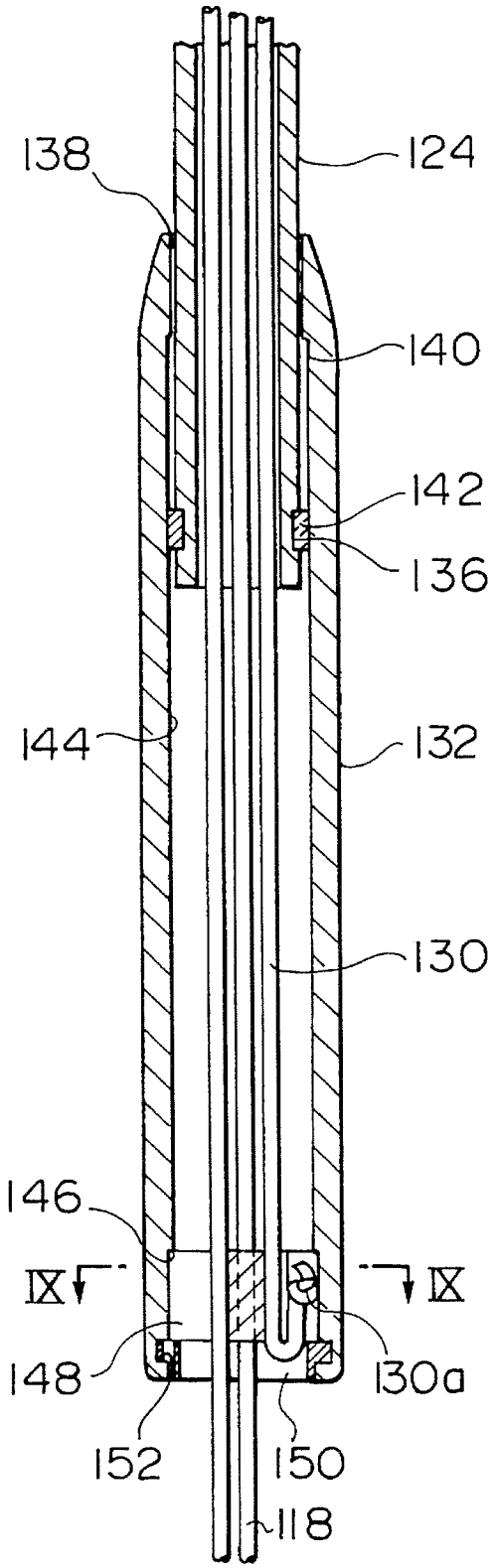
FIG. 8 is a sectional view of the grip shown in FIG. 7.
Figure 9:
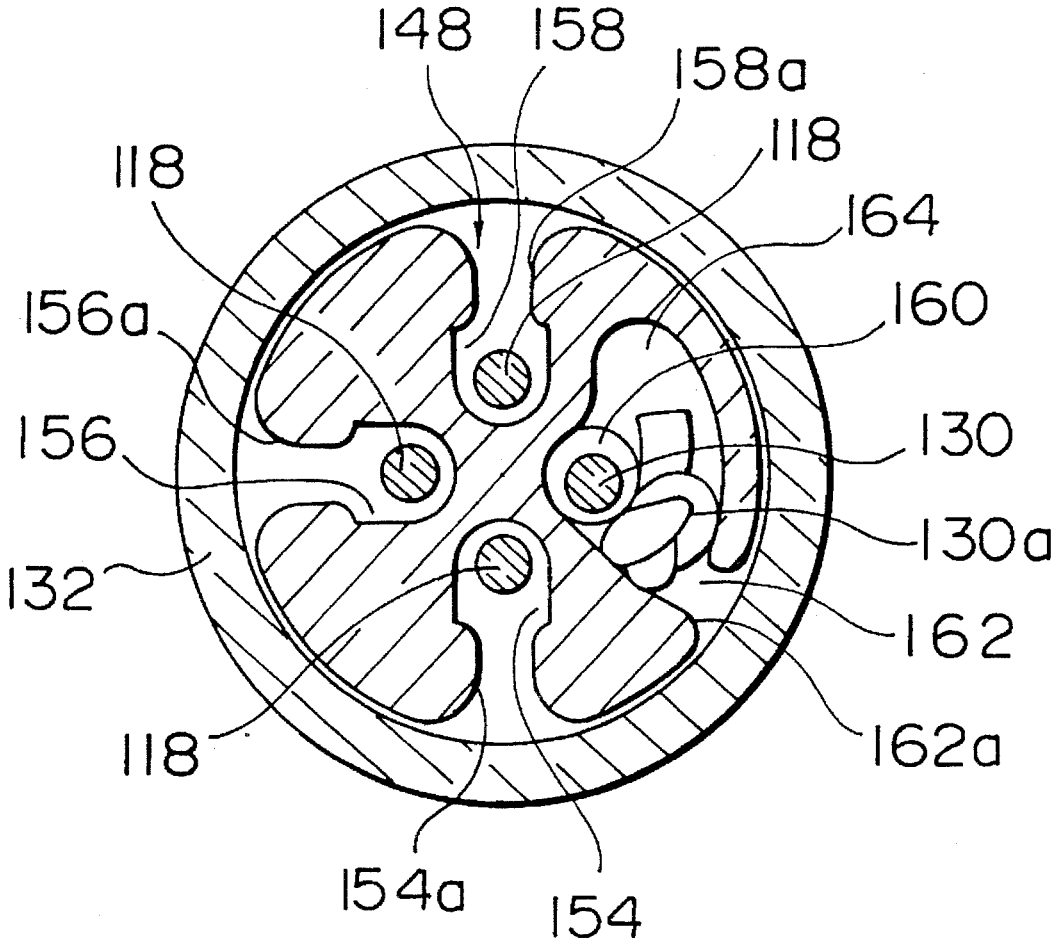
FIG. 9 is a sectional view taken along the line IX—IX of FIG. 8.

FIG. 7 shows a disassembly perspective view of a construction near a grip 32, and FIG. 8 shows a sectional view thereof. The cross section of a rotating operation rod 124 is hexagonal and a small-diameter portion 136 having a smaller diameter than the portion having the hexagonal cross section is formed near the bottom end. An insertion hole 138 having a hexagonal cross section, to which the outside diameter of the rotating operation rod 124 can be fit, is formed at the top end of the grip 132. A stepped portion 140 is formed at the lower end of the insertion hole 138 within the grip 132 and the diameter of the stepped portion 140 is larger along the diameter than the insertion hole 138. A space portion 144 to which a first loosening preventive ring 142 can be fit so that the ring can move vertically relative to the stepped portion is formed. A stepped portion 146 is formed at the bottom of the internal space of the grip 132, and the stepped portion 146 has a larger diameter than the space portion 144. A twining preventive ring 148 can be fit to this portion so that the ring is freely rotatable. A groove portion 152 to which a second loosening preventive ring 150 can be fit is formed along the circumference at the bottom of the position in which the twining preventive ring 148 in the grip 132 is disposed. Parts of the circumference of the first loosening preventive ring 142 and the second loosening preventive ring 150 are cut off. In the twining preventive ring 148, as shown in FIG. 5, four through holes 154, 156, 158, 160 are formed along the length thereof at a predetermined distance along the circumference. Of these holes, three through holes 154, 156, 158 are formed so as to be large enough for the respective lifting cord 118 to pass through. The insertion hole 160 is as large as the stopper releasing cord 130 can pass therethrough. A through hole 162 through which the stopper releasing cord 130 can be inserted is formed at a position near the outside circumference relative to the through hole 162 of the twining preventive ring 148. Slits 154*a*, 156*a*, 158*a*, 162*a* are formed from the respective through holes 154, 156, 158, 162 to the circumference of the twining preventive ring 148.

The bottom end of the rotating operation is inserted into the insertion hole 138 of the grip 132. The first loosening preventive ring 142 is fit to the small-diameter portion 136 of the rotating operation rod 124. The grip 132 is prevented from slipping out of the rotating operation bar 124 by first loosening preventive ring's being in contact with the stepped portion 140. When the stopper 121 is activated, as shown in FIG. 4, the first loosening preventive ring 142 is located downward of the stepped portion 40 due to tension which raises the stopper releasing cord 130, so that the first loosening preventive ring 142 is not in contact with the stepped portion 140. The twining preventive ring 148 is fit to the bottom portion of the grip 132 so that the ring 148 is freely rotatable. The top end of the twining preventive ring 148 is in contact with the stepped portion 146 so that the ring 148 is blocked from moving upward. The second loosening preventive ring 150 is embedded in the groove portion 152 of the grip 132, so that the twining preventive ring 148 is blocked from moving downward. The lifting cord is introduced from the rotating operation rod, passed through the-space portion 144 of the grip 132 and through the through holes 154, 156, 158 of the twining preventive ring 148, and finally introduced from the bottom of the grip 132. After the stopper releasing cord 130 is introduced from the rotating operation rod 124, the cord 130 is inserted through the space portion 144 of the grip 132 and the through hole 160 of the twining preventive ring 148. The cord 130 is bent at the bottom of the twining preventive ring 148 toward the through hole 162, introduced from the top end of the through hole 162 and then the knot 130*a* is formed at the end of the cord 130 and contained in the large-diameter portion 164. As a result, the knot 130*a* of the stopper releasing cord 130 is prevented from slipping out of the through hole 162.

When the inclination angle of the slats 110 is changed, the grip 132 is held by hand and revolved. Consequently, the rotating operation rod 124 rotates integratedly with the grip 132, so that the revolution of the rotating operation rod 124 is transmitted to the rotating drum 117 which rotates integratedly with the rotating shaft 123 by means of the tilter 120 through the tilter input shaft 122, in order to revolve the rotating drum 117. Thus, the inclination angle of the slats 110 is changed. Because even if the grip 132 is revolved, the twining preventive ring 148 which is fit thereto so as to be freely rotatable is not revolved, the lifting cords 118 and the stopper releasing cord 130 are not revolved neither. Thus, the lifting cords and the stopper releasing cord 130 are not twined.

Because connection of the grip 132 and the rotating operation rod 124 is achieved by first loosening preventive ring 142's being in contact with the stepped portion 140 of the grip 132, it is easy to install the grip 132 to the rotating operation rod 124. Thus, if the grip is colored in the same color system as the slats, even when the rotating operation rod is transparent, various demands can be met by preparing grips of a predetermined number of color types and combining a grip of a demanded color with the rotating operation rod, thereby reducing stock risk.

Additionally, because the bottom end of the stopper releasing cord 130 is contained in the large-diameter portion 164 of the twining preventive ring 148, the stopper releasing cord 130 does not protrude from the bottom of the grip 132, thereby not deteriorating the appearance.

By forming slits 154*a*, 156*a*, 158*a*, 162*a* on the twining preventive ring 148 so that they extends from the respective through holes 154, 156, 158, 162 to the circumference thereof, it is possible to facilitate insertion of the lifting cords 118 and the stopper releasing cord 130 through the respective through holes 154, 156, 158, 162.

Next, still another embodiment of the present invention will be described with reference to FIG. 10. The present embodiment contains a universal joint having an improved construction. Because the entire construction of the blind apparatus can be substantially the same as described in FIGS. 1– 6, the description thereof is omitted.

Figure 10:
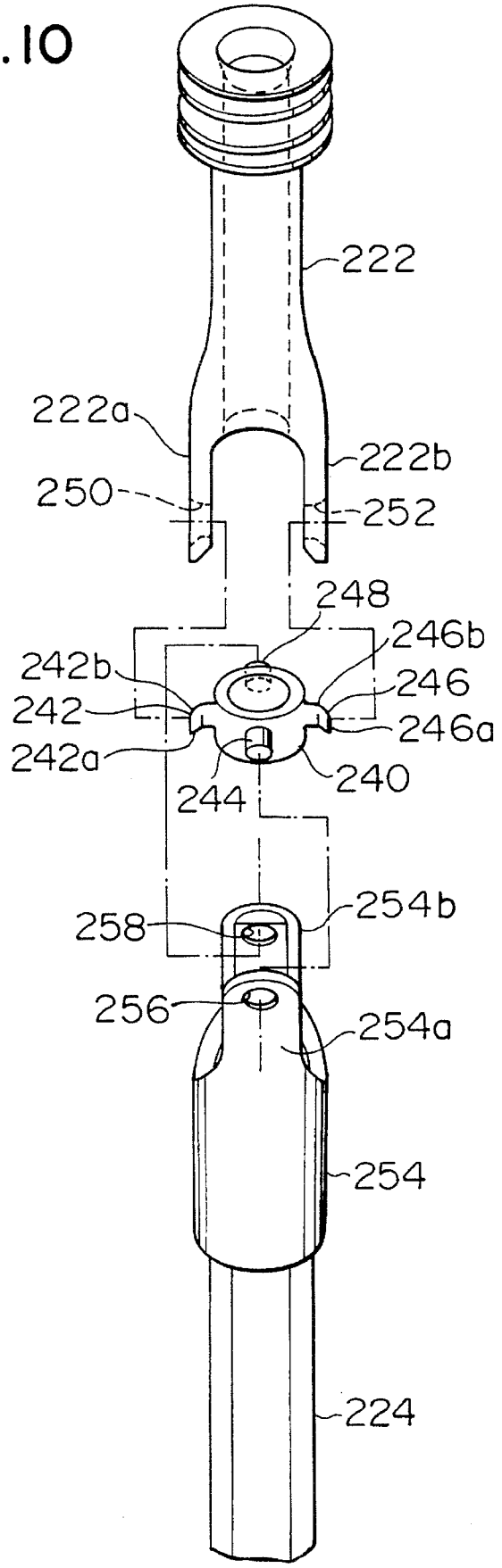
FIG. 10 is an exploded perspective view of a universal joint used in a different embodiment.

FIG. 10 shows a disassembly perspective drawing of a universal joint 228. The universal joint 228 comprises first bifurcated pieces 222*a*, 222*b* of the tilter input shaft 222, second bifurcated pieces 254*a*, 254*b* of the rotating operation rod 224 and a connecting piece 240.

The connecting piece 240 has connecting pins 242, 244, 246, 248 which protrude from the circumference by every 90 degrees. Protruding portions 242*a*, 246*a* which extend along the axial direction of the connecting piece 240 are formed at the heads of two connecting pins 242, 246 located symmetrically relative to each other, of the connecting piece 240. On sides opposite to the protruding portions 242*a*, 246*a* formed at the heads of the connecting pins 242, 246, slant faces 242*b*, 246*b* which slant more toward the axis of the connecting pins 242, 246 as the tip is approached are formed. No protruding portion or slant face is formed on the connecting pins 244, 248 of the connecting piece 240.

The tilter input shaft 222 has the first bifurcated pieces 22*a*, 222*b* disposed at bottom positions which face each other so that the bifurcated pieces 222*a*, 222*b* protrude along the axis of the tilter input shaft 222. The first bifurcated pieces 222*a*, 222*b* have first pin receiving holes 250, 252, respectively, which allow the connecting pins 242, 246 of the connecting piece to be fit thereto so that the connecting piece 240 is freely rotatable, the diameter of the first pin receiving holes being increased in the form of a cone as the circumference is approached. Consequently, even if the first bifurcated pieces 222*a*, 222*b* of the tilter input shaft 222 are bent due to a downward load applied to the universal joint 228 when the rotating operation rod 224 is rotated, the connecting pins 242, 246 which are fit into the first pin receiving holes 250, 252 hook on the conical surfaces of the first pin receiving holes 250, 252, so that the connecting pins 242, 246 do not slip out of the first pin receiving holes 250, 252.

The rotating operation rod 224 has a hollow connecting member 254 having second bifurcated pieces 254*a*, 254*b* which are disposed at positions facing each other, the bifurcated pieces protruding along the length of the rotating operation rod 224. The second bifurcated pieces 254*a*, 254*b* contain second pin receiving holes 256, 258 which allow the connecting pins 244, 248 of the connecting piece 240 to be fit thereto so that the connecting pins are freely rotatable.

The assembly of the universal joint 228 is achieved by fitting the connecting pins 244, 248 of the connecting piece 240 into the second pin receiving holes 256, 258 of the rotating operation rod 224 and further by fitting the connecting pins 242, 246 into the first pin receiving holes 250, 252 of the tilter input shaft 222. When the connecting pins 242, 246 of the connecting piece 240 are fit into the first pin receiving holes 250, 252 of the tilter input shaft 222, the connecting pins 242, 246 are easy to be fit into the first pin receiving holes 250, 252 because slant surfaces 242*b*, 246*b* are formed on the connecting pins 242, 246.

According to the present embodiment, the protruding portions which protrude along the axis of the connecting piece are formed at the heads of the connecting pins of the connecting piece which is connected with the tilter input shaft. Then, the first pin receiving holes in which the diameter thereof increases in the form of a cone as the circumference is approached are formed in the first bifurcated pieces of the tilter input shaft. Then, the connecting pins having a protruding portion at the head are fit into the first pin receiving holes in order to connect the connecting piece to the tilter input shaft.

Consequently, even if the first bifurcated pieces of the tilter input shaft are bent due to a downward load applied to the universal joint when the rotating operation rod is rotated, the protruding portion of the connecting pin hooks on the conical surface of the first pin receiving hole, so that the connecting pin does not slip out of the first pin receiving hole. Thus, it is possible to prevent the rotating operation rod from being removed from the tilter input shaft.

Because the connecting pin is not loose from the first pin receiving hole unless a washer or the like is attached to the tip of the connecting pin, the assembly of the universal joint is easy thereby enhancing workability. Additionally, because slant surface is formed on a side opposite to the protruding portion, of the head of connecting pin in which the protruding portion is formed, it becomes further easy to fit the connecting pins into the first pin receiving holes, thereby further improving efficiency of the work.

Next, still another embodiment of the present invention will be described with reference to FIGS. 11 to 17. This embodiment contains a modified tilting mechanism. Because the entire construction of the blind apparatus is substantially the same as described in FIGS. 1 to 6, the description thereof is omitted. One end of the stopper releasing cord 330 shown in FIG. 12 capable of releasing the holding of the lifting cord 318 is connected to the stopper. The other end of the stopper releasing cord 330 is connected to the grip 332 through the tilter shaft 322 and the rotating operation rod 324.

Figure 11:
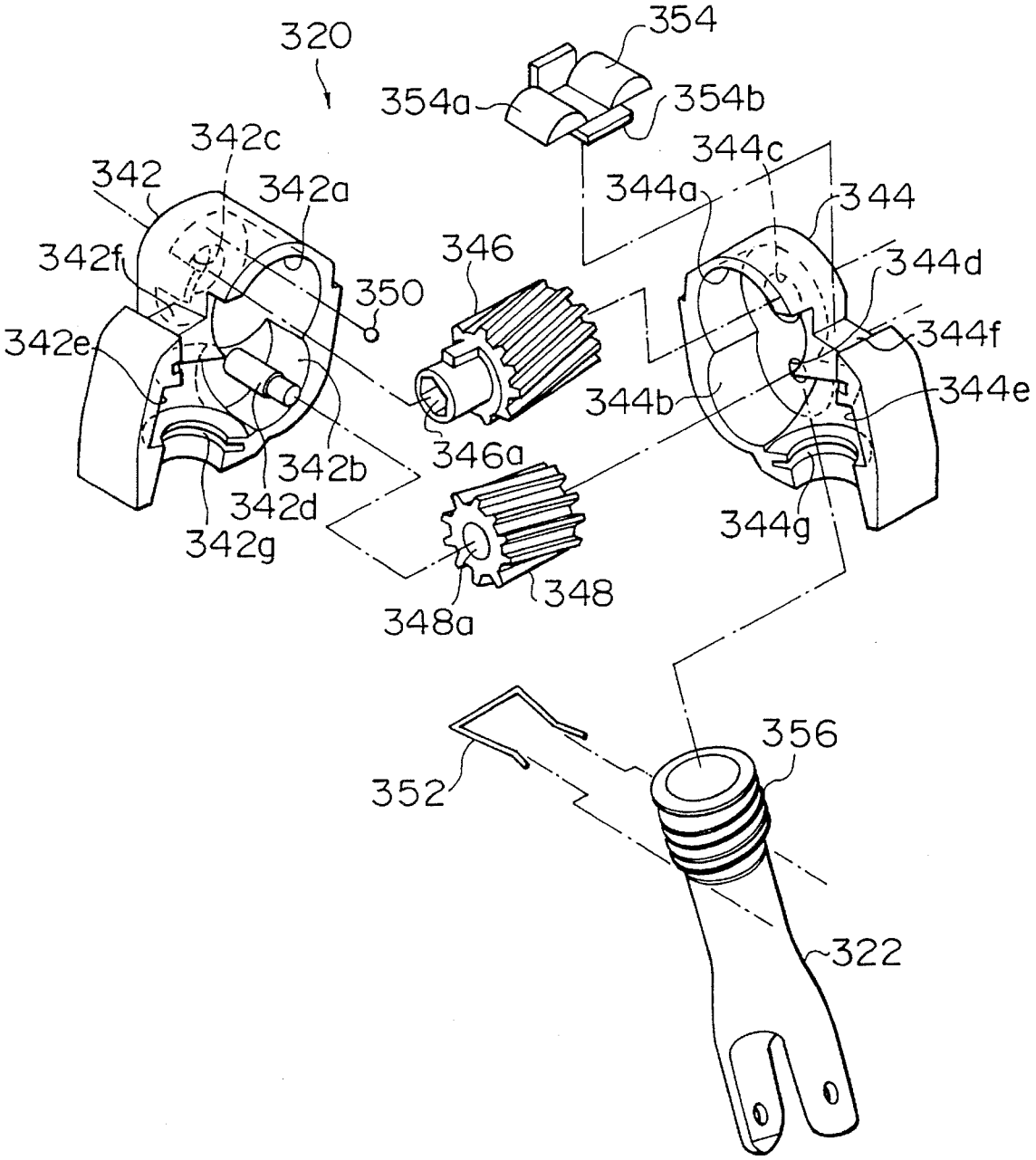
FIG. 11 is an exploded perspective view of a tilter used in a different embodiment.

FIG. 11 shows a disassembly perspective view of the tilter 320. The tilter 320 comprises a tilter shaft 322, tilter cases 342, 344, first and second worm wheels (worm wheels) 346, 348, a ball 350, a torque applying device 352 and a cord guide 354.

A hollow worm 356 which can mesh with the second worm wheel 348 is formed at the top of the tilter shaft 322 so that the hollow worm 356 is integrated with the tilter shaft 322.

The tilter cases 342, 344 include the first and second space portions 342*a*, 342*b* and 344*a*, 344*b* to which the first and second worm wheels 346, 348 can be fit so as to be rotatable. Insertion holes 342*c*, 344*c* in which the rotating shaft 323 can be inserted so as to be rotatable and which rotatably supports the first worm wheel 346, the insertion holes going through the respective walls, are formed in the first space portions 342*a*, 344*a*. A connecting supporting portion 342*d* which supports the second worm wheel 348 so as to be rotatable and which can be fit to a connecting hole 344*d* formed so as to pass through the wall of the second space portion 344*b* protrudes in the second space portion 342*b*. The tilter cases 342, 344 contain the third space portions 342*e*, 344*e* which are capable of supporting the worm 356. Groove portions 342*g*, 344*g* in which the torque applying device 352 can be inserted are formed below the third space portions 342*e*, 344*e* shown in FIG. 11, of the tilter cases 342, 344. Dented portions 342*f*, 344*f* to which the cord guide 354 can be fit are formed on the top portions of the tilter cases 342, 344.

An insertion hole 346*a* having a hexagonal cross section is formed in the rotation center of the first worm wheel 346. The rotating shaft 323 having a hexagonal cross section can be fit into the insertion hole 346*a* so as to be integrally rotatable with the first worm wheel. An insertion hole 348*a* which the connecting supporting portion 342*d* can be fit into is formed in the rotation center of the second worm wheel 348 and the second worm wheel is rotatably supported by means of the connecting supporting portion 342*d* as described above.

The torque applying device 352 is constructed by means of a substantially U-shaped spring both ends of which are slightly deflected outward.

The cord guide 354 comprises circular shaped guiding portions 354 for guiding the motion of the lifting cords 318 and a connecting portion 354*b* which is embedded to the dented portions 342*f*, 344*f* of the tilter cases 342, 344.

Figure 12:
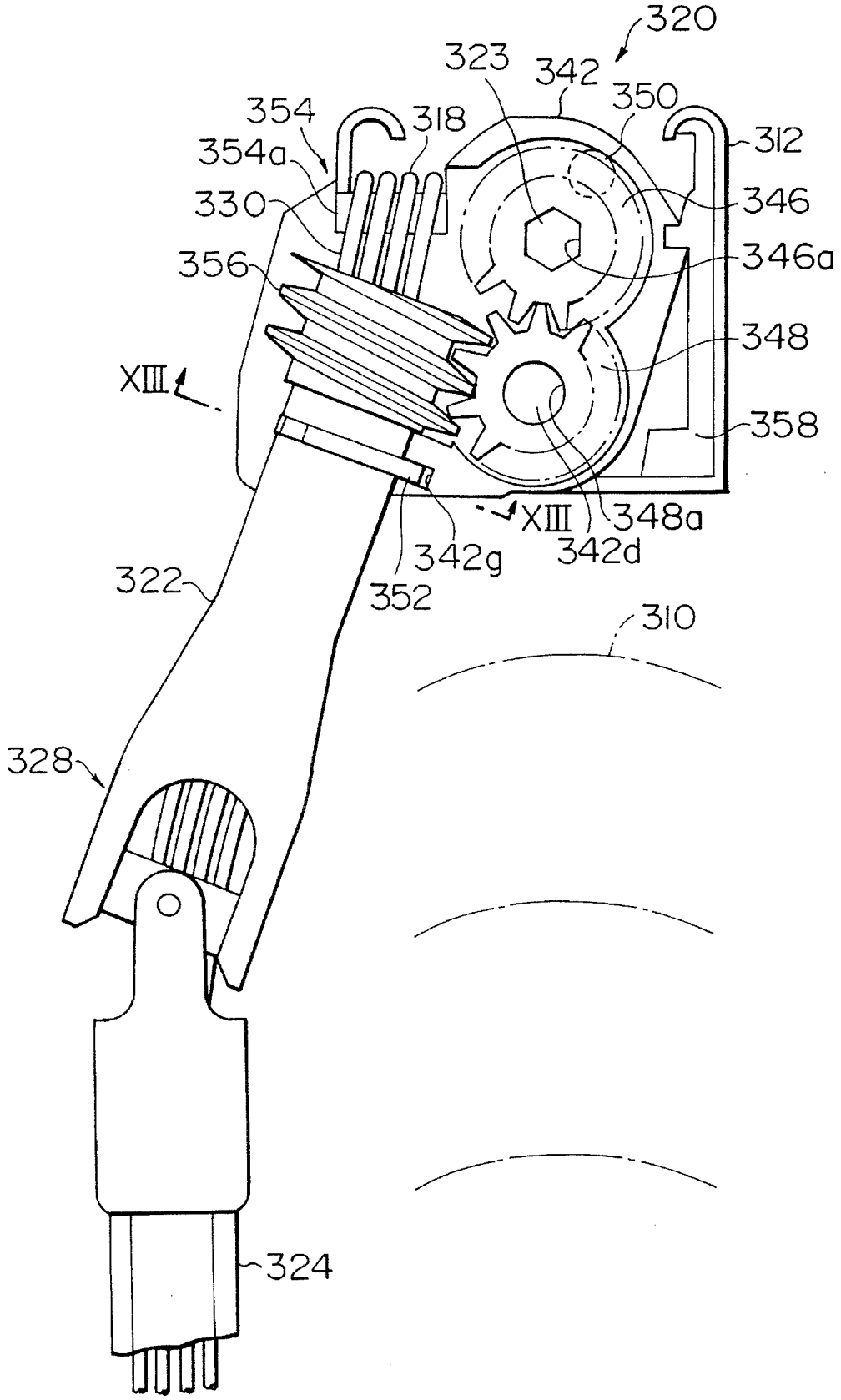
FIG. 12 is an illustration of the tilter of FIG. 11 attached to a head box.

FIG. 12 shows the tilter 320 which is mounted on the head box 312. A tilter case 342 is mounted on a fixing member 358 provided on the inside wall of the head box 312. Consequently, the tilter case 342 is fixed to the head box 312. The tilter case 344 is also treated in the same manner as for the tilter case 342 although the representation thereof is omitted. The first worm wheel 346 is disposed in the first space portion 342*a* of the tilter case 342 through a ball 350. The rotating shaft 323 inserted from the insertion hole 342*c* of the tilter case 342 is fit into the insertion hole 346*a* of the first worm wheel 346 so that the rotating shaft rotates integrally with the first worm wheel. In the second space portion 342*b* of the tilter case 342, the second worm wheel 348 is disposed so that the connecting supporting portion 342*d* is inserted through the insertion hole 348*a* of the second worm wheel 348. The first worm wheel 346 meshes with the second worm wheel 348 in order to transmit driving force therebetween.

A worm 356 is engaged with the second worm wheel 348 in order to transmit a rotation force to the second worm wheel. The worm 356 is rotatably supported by the third space portions 42*e*, 344*e* of the tilter cases 342, 344, respectively. The torque applying device 352 is mounted on the portion of the tilter shaft 322 disposed within the tilter case 342 below the worm 356 by inserting the tilter shaft 322 into the U-shaped space portion of the torque applying device to elastically nip the tilter shaft therewith. The torque applying device 352 which is mounted on the tilter shaft 322 is inserted into the groove portions 342*g*, 344*g* of the tilter cases 342, 344 and both end portions thereof are arranged so as to face the bottom of the tilter case 342 as shown in FIG. 13.

The cord guide 354 is fit to the dented portions 342*f*, 344*f* of the tilter cases 342, 344. The lifting cords 318 are disposed on the guide portion 354*a* of the cord guide 354 so that the cords are movable. The lifting cords 318 go through the worm 356, the tilter shaft 322 and the rotating operation rod 324 so that the cords 318 are movable.

Next, the operation of the present embodiment will be described. When the tilter shaft 322 is revolved counterclockwise in FIG. 13 by rotating the rotating operation rod 324, the torque applying device 352 is rotated counterclockwise from the state shown in FIG. 13 accompanied by the rotation of the tilter shaft 322 and then, the left end shown in FIG. 14 is hooked on the bottom surface of the tilter case 342, so that the condition shown in FIG. 14 occurs. When the rotating operation rod 324 is further revolved in the same direction, the tilter shaft 322 is also revolved counterclockwise in FIG. 14. Thus, a counterclockwise rotating force in FIG. 14 is applied to the torque applying device 352 so that the torque applying device 352 is forced so as to expand. The rotating torque applied to the tilter shaft 322 increases to reach a large value as shown in FIG. 15 after the left end of the torque applying device in FIG. 14 is hooked on the bottom surface of the tilter case 342 until the torque applying device 352 is forced so as to expand. The rotating torque of the tilter shaft 322 after the torque applying device 352 is expanded decreases and is maintained at a small value as shown in FIG. 15. That is, a braking force is applied to the tilter shaft 322 just when the rotation of the tilter shaft starts and after the rotation of the tilter shaft has started, not so large braking force is applied thereto.

Figure 13:
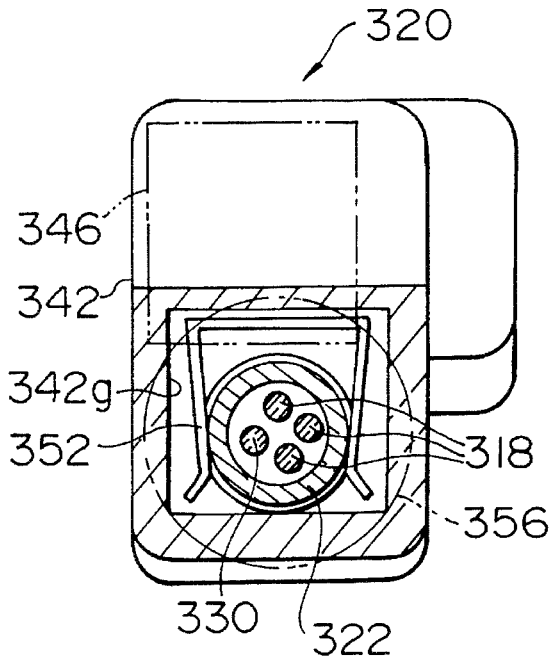
FIG. 13 is a sectional view taken along the line XIII—XIII of FIG. 12.
Figure 14:
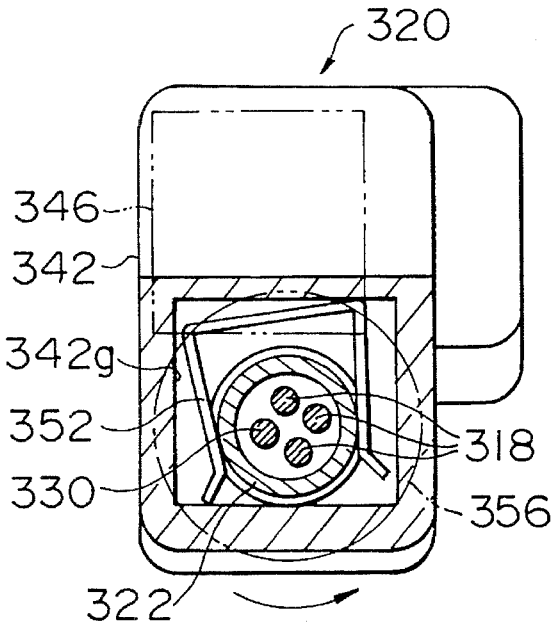
FIG. 14 is an illustration of a torque adding device in a state in which tilter shaft has been rotated.
Figure 15:
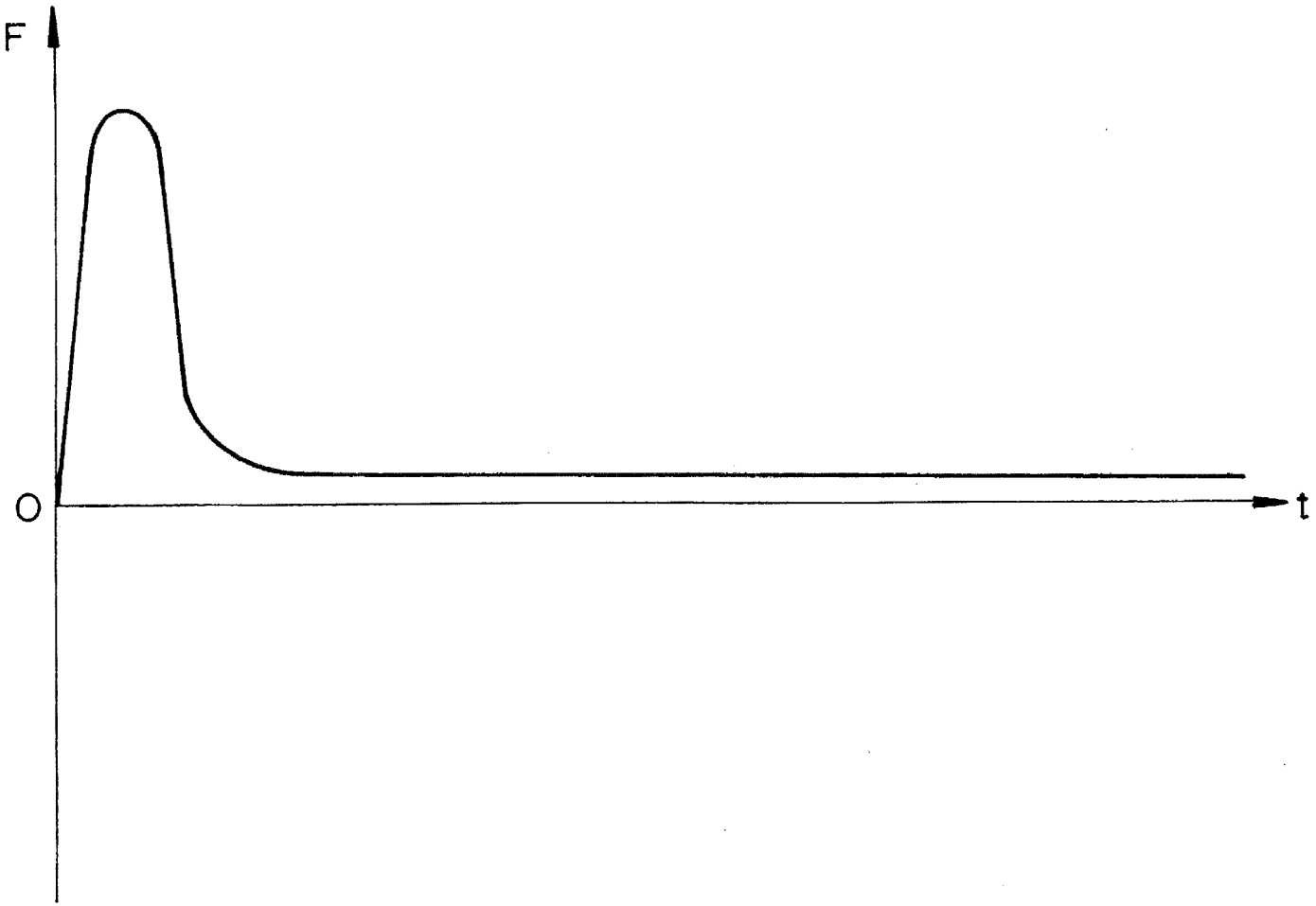
FIG. 15 is a diagram showing the manner in which the driving torque is changed in relation to time.

If the rotating operation rod 324 is revolved in a direction opposite to the aforementioned direction in order to revolve the tilter shaft 322 clockwise in FIG. 13, the right end of the torque applying device 352 in FIG. 14 comes into contact with the bottom surface of the tilter case 342, so that the torque applying device 352 is forced so as to expand. Thus, the same braking force as described above is applied to the tilter shaft 322.

Consequently, a braking force is applied to the tilter shaft 322 when the rotation of the tilter shaft starts, thus it is possible to decrease the gear ratio between the worm 356 and the second worm wheel 348. For this reason, it is possible to incline the slats at a large inclination angle with a small number of rotations of the rotating operation rod 324. After the rotation of the tilter shaft has started, the braking force is reduced considerably as compared with when the rotation thereof starts, so that the rotating operation shaft 324 can be revolved smoothly.

Due to the rotation of the rotating operation rod 324, the lifting cords which pass through the internal space thereof may be sometimes twisted. Thus, a untwisting force is applied to the tilter shaft 322 so that this force is tempted to rotate the rotating shaft 323. However, because the force tempted to rotate the rotating shaft 323 is larger than the braking force applied to the tilter shaft 322 when the rotation thereof starts, the rotating shaft 323 is not revolved.

When an external force such as the wind is applied to the slats 310, the rotating shaft 323 is tempted to rotate. However, because the force tempting to rotate the rotating shaft 323 is larger than a braking force applied to the tilter shaft when the rotation thereof starts, the rotating shaft 323 is not revolved.

Figure 16:
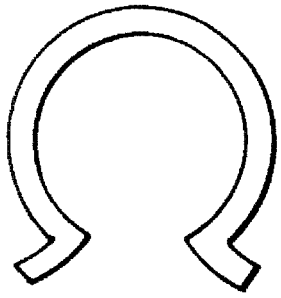
FIG. 16 is an illustration of a different form of the torque adding device.
Figure 17:
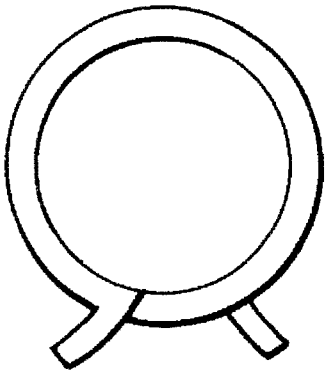
FIG. 17 is an illustration of a still different form of the torque adding device.

Although, in the aforementioned embodiment, the torque applying device is constructed by using a substantially U-shaped spring both ends of which are deflected slightly outward, the present invention is not restricted to this embodiment. For example, a circular spring both ends of which are deflected slightly outward as shown in FIG. 16 can be used or a substantially circular spring in which part of both ends thereof is intersected and in which the both ends are deflected slightly outward can be also used.

According to the present invention, a torque applying device in which a large rotating torque is needed When the rotation of the tilter shaft is started and in which the rotation can be attained by a smaller rotating torque after the rotation of the tilter shaft has started as compared with when the rotation thereof is started, is provided at the tilter shaft.

Consequently, a braking force is applied to the tilter shaft when the rotation of the tilter shaft is started. Due to external force applied to the slats such as the wind pressure or a repellant force which is caused when the rotating operation rod is revolved if the lifting cords are inserted through the rotating operation rod, the worm and the worm wheel are blocked from being revolved, so that the rotation of the rotating shaft is hindered. Thus, the slats are not inclined accidentally so that it is possible to maintain the blind in a desired condition.

Further, it is possible to reduce gear ratio between the worm and the worm wheel because a braking force is applied to the tilter shaft when the rotation of the tilter shaft starts. Accordingly, the efficiency of transmission between the worm and the worm wheel can be increased, thus it is possible to incline the slats at a large angle by a small number of the revolutions of the rotating operation rod.

After the rotation of the tilter shaft has started, a braking force applied to the tilter shaft decreases considerably as compared with when the rotation thereof starts, thus it is possible to revolve the rotating operation rod smoothly.

A further embodiment of the present invention will be described with reference to FIGS. 18 to 20. The present embodiment has a modified hook device on which the lifting cords are hung. Because the entire construction of the blind apparatus may be substantially the same as described in FIGS. 1 to 6, the detailed description thereof is omitted.

Figure 18:
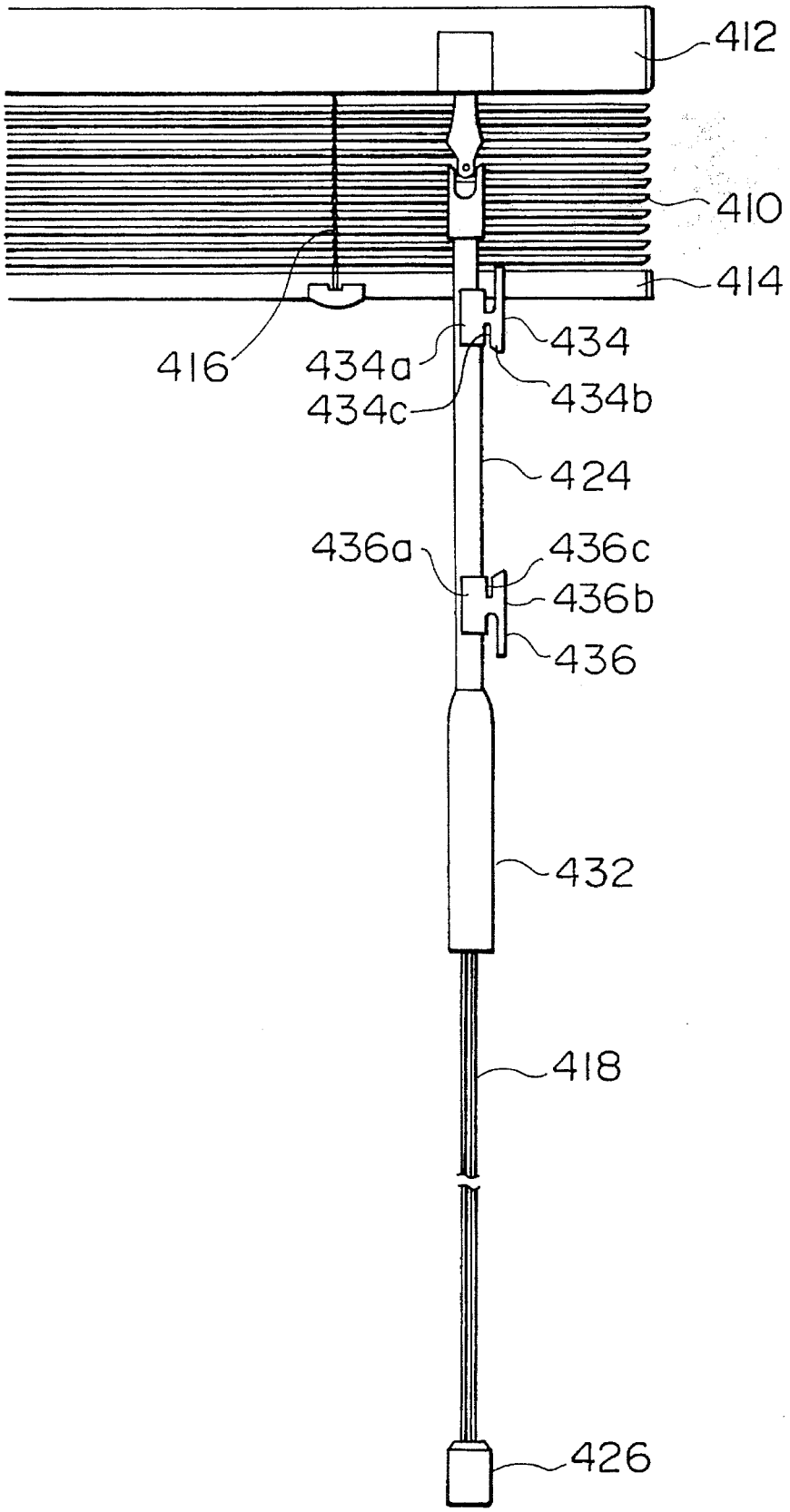
FIG. 18 is a schematic illustration of a blind apparatus as a different embodiment of the present invention.
Figure 19:
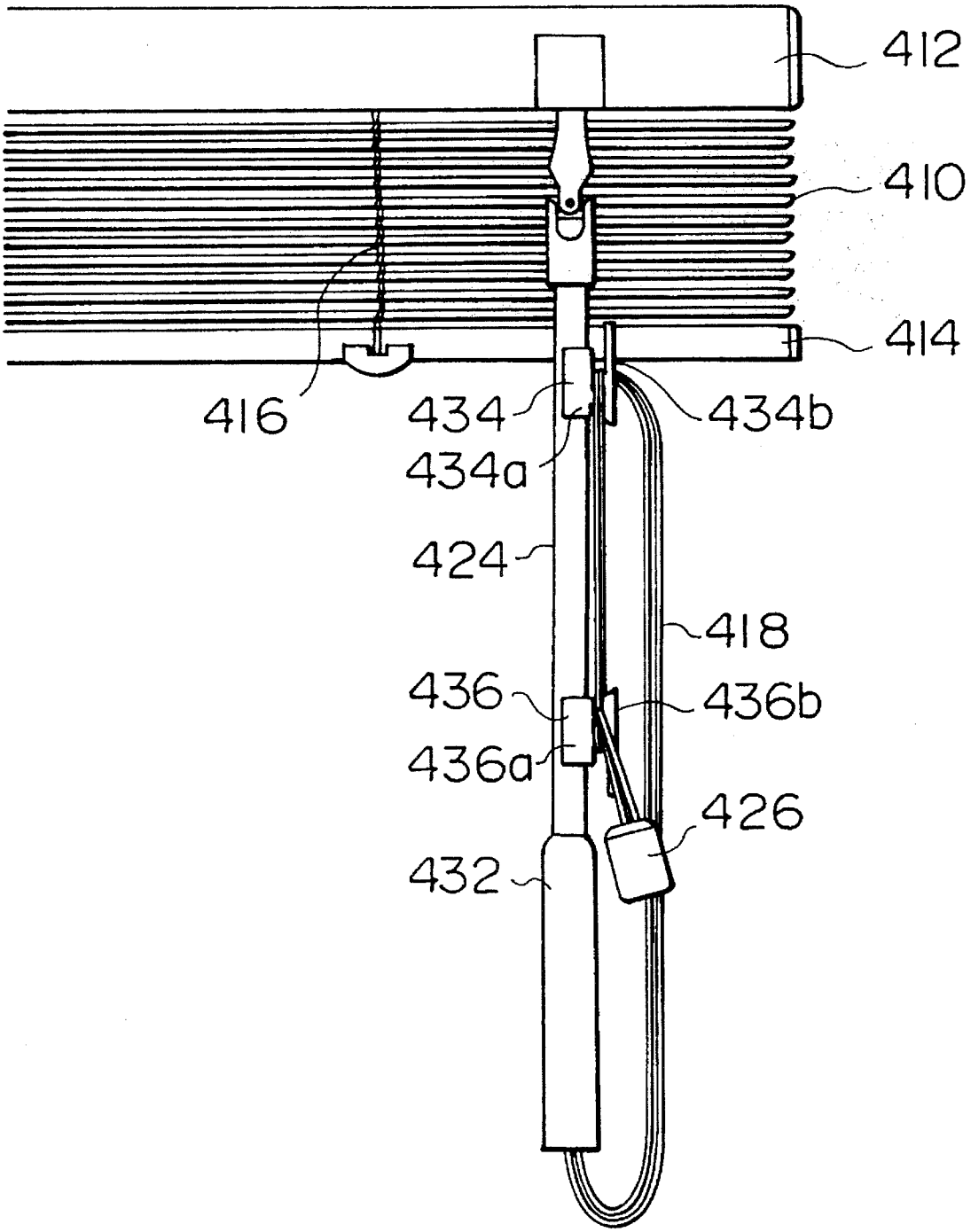
FIG. 19 is an illustration of hooks on which lifting cords are wound, in the embodiment shown in FIG. 18.
Figure 20:
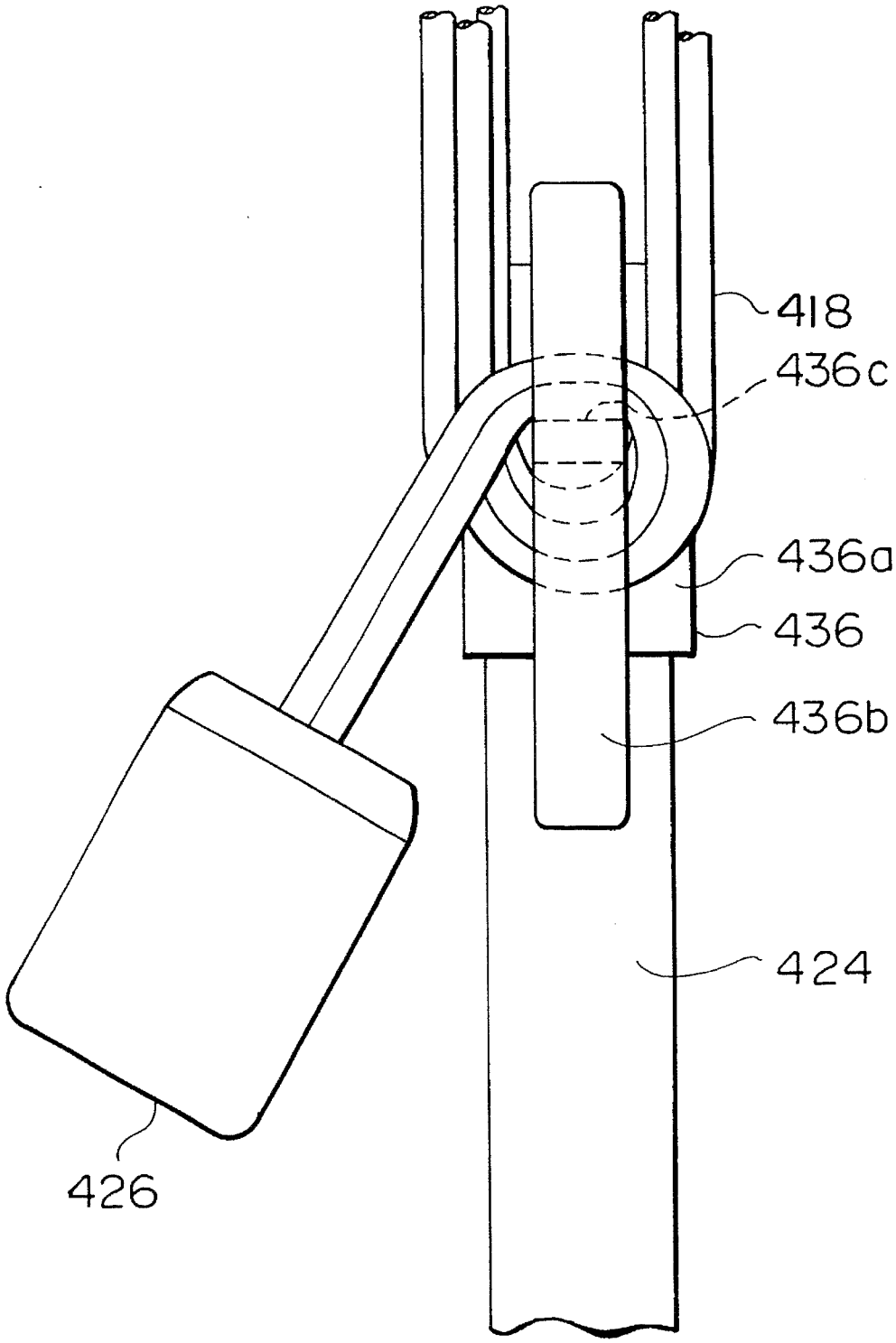
FIG. 20 is an illustration of the manner in which the ends of lifting cords are treated.

Referring to FIGS. 18 to 20, one end of the lifting cord 418 is connected to the bottom rail 414 and the other end thereof is inserted through the insertion holes (not shown) disposed on the slats 410, introduced into the head box 412 and introduced out near one end of the head box 412. Then, the lifting cord passes through the rotating operation rod 424 and the grip 432 and is connected to the knob 426 disposed at the bottom of the grip 432 so that the lifting cord can be lifted up or down. The rotating operation rod 424 has two hooks 434, 436 on which the lifting cords 418 introduced from the bottom end of the rotating operation rod 424 can be hung, the hooks being provided at two positions which are located at two positions vertically apart from each other. The hook 434 comprises a linking portion 434*a* which can be attached to the rotation operation rod 424 by elastic deformation and a T-shaped protruding portion 434*b* which protrudes from the side of the linking portion 434*a*. A nipping portion 434*c* which is a groove having a width smaller than the diameter of the lifting cord 418 is formed between the protruding portion 434*b* (one side piece) which protrudes downward of the T shape and the linking portion 434*a*. The gap between the protruding portion 434*b* which protrudes upward and the linking portion 434*a* is formed so as to be larger than the diameter of the lifting cord 418. Although the hook 436 is the same as the hook 434, the hook 436 is fit to the rotating operation rod 424 reversely relative to the vertical direction. A groove-like nipping portion 436*c* having a gap narrower than the diameter of the lifting cord 418 is formed between the T-shaped protruding portion 436*b* (one side piece) which protrudes upward of the hook 436 and the linking portion 436*a*. A gap between the protruding portion 436*b* which protrudes downward and the linking portion 436*a* is formed so as to be larger than the diameter of the lifting cord 418.

FIG. 19 shows the hooks 434, 436 on which the lifting cords 418 are hung. The lifting cords 418 introduced from the bottom end of the grip 432 are wound on the protruding portion 434*b* which protrudes upward of the hook 434 and the protruding portion 436*b* which protrudes downward of the hook 436. As shown in FIG. 20, one ends of the lifting cords are wound around the nipping portion 436*c* of the hook 436. Because the gap of the nipping portion 436*c* is smaller than the diameter of the lifting cord 418 as described above, the lifting cords 418 wound around the nipping portion 436*c* are nipped elastically and held by the nipping portion 436*c*. Consequently, the lifting cords 418 are not unwound easily.

Due to the length of the lifting cords 418, when the ends of the lifting cords 418 are located at the hook 434, the ends of the lifting cords 418 are wound around the protruding portion 434*b* which protrudes upward of the hook 434 after the lifting cords are wound on the nipping portion 434*c* or the mounting position of the hook 434 is adjusted because the hook 434 can be elastically attached to the rotating operation rod 424.

According to the present invention, the hook comprises a linking portion attachable to the rotating operation rod and a T-shaped protruding portion which protrudes sideways of the linking portion. One piece of the T-shaped portion of the protruding portion and the linking portion form a groove-like nipping portion capable of nipping the lifting cord.

Because the lifting cords are nipped elastically by the nipping portion by winding the ends of the lifting cords wound from one hook to another hook around the nipping portion, the lifting cords are elastically nipped by the nipping portion in order to prevent the lifting cords from being unwound from the hook easily.

A still further embodiment of the present invention will be described with reference to FIGS. 21 to 24. The present embodiment is preferably applicable to a blind apparatus which is horizontally long and the lifting cords are employed at three or more positions along the length of the apparatus including the center portion of the apparatus.

According to the present embodiment, the slippage of the lifting cord connected to the center portion of the blind apparatus, bearing the largest load of three or more lifting cords used in such a large size blind apparatus, relative to a stopper device, is eliminated to prevent the center portion of the slats from drooping.

Figure 21:
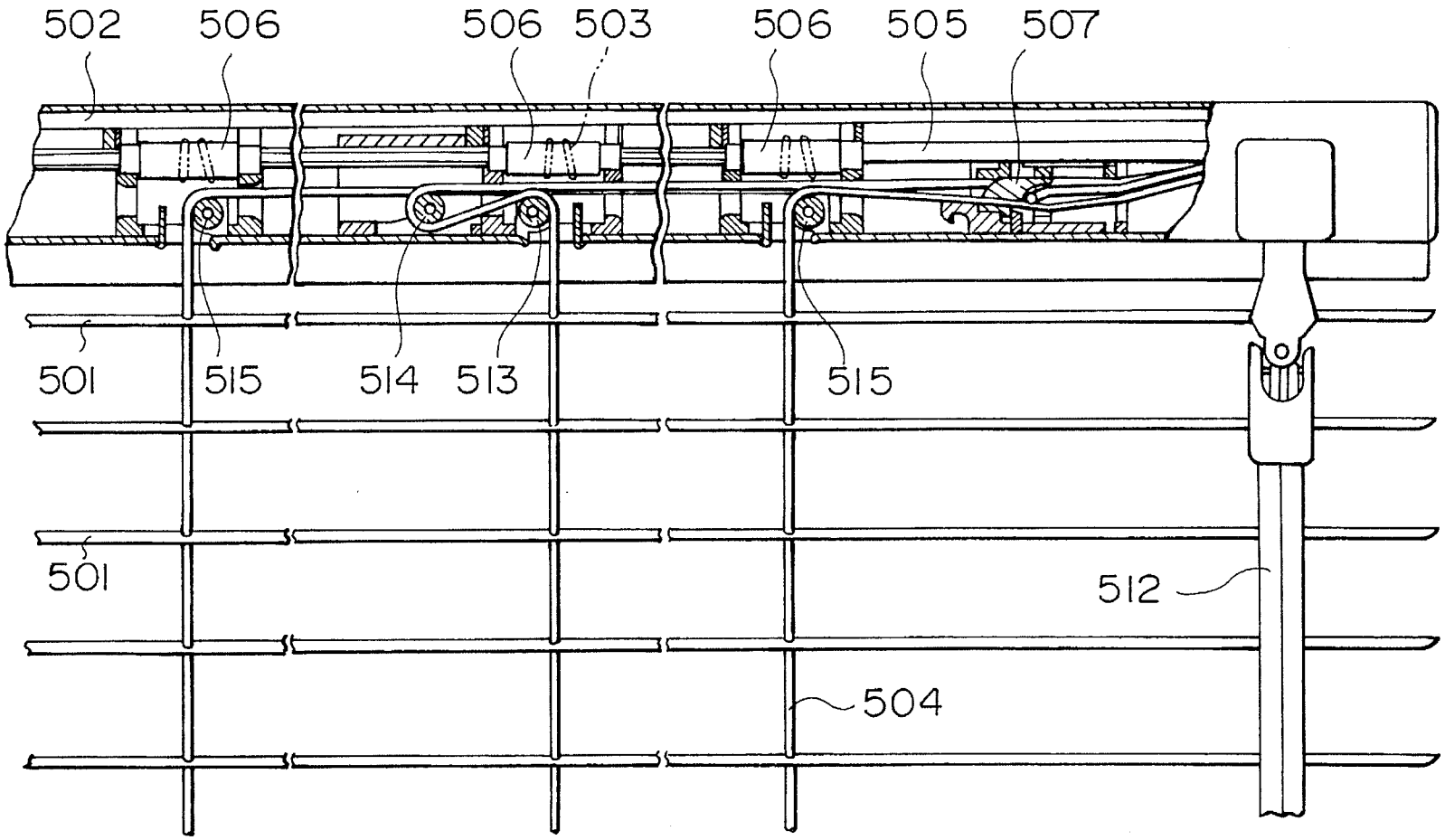
FIG. 21 is a partly-sectioned front elevational view of a different embodiment of the blind apparatus of the present invention.

FIG. 21 shows a horizontal type blind apparatus according to the present invention. Referring to the same Figure, reference numeral 501 designates a slat, numeral 502 designates a head box, numeral 503 designates a ladder cord which support a plurality of slats at a vertical distance, numeral 504 designates a lifting cord, numeral 505 designates a rotating shaft which revolves the slats, and numeral 506 designates a rotating drum disposed on the rotating shaft. The ladder cord 503 is wound around the rotating drum 6, and by revolving the rotating shaft 505, the ladder cord 503 is moved vertically along the length thereof to revolve the slats in order to adjust light shielding. Because such mechanism is well known, the detailed description thereof is omitted.

The bottom ends of the lifting cords 504 are connected to the bottom rail (not shown) disposed at the bottommost of the slats 1, the lifting cords are introduced through the slats, then introduced into the head box 502 and led horizontally within the head box to one end thereof. The lifting cord stopper device 507 which holds the motion of the lifting cord 504 is contained at one end of the head box.

Figure 22:
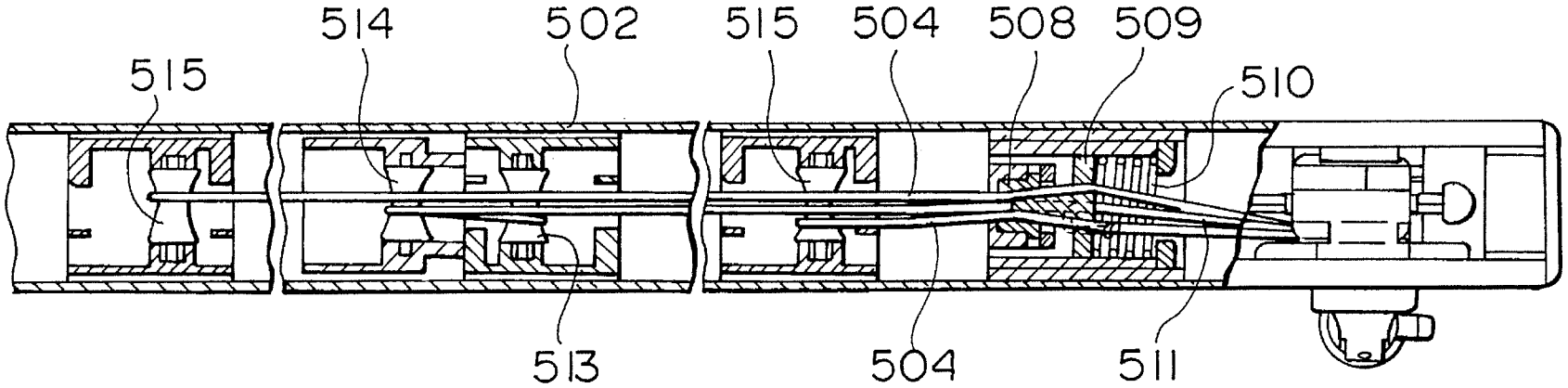
FIG. 22 is a partly-sectioned plan view of the blind apparatus shown in FIG. 21.

As shown in FIG. 22, the lifting cord stopper device 507 comprises a cord nozzle 508, a cord stopper 509 and a spring 510 which elastically presses the cord stopper against the cord nozzle in order to fasten the lifting cord 504 between the cord nozzle and the cord stopper, thereby holding the slats at a desired position. To release the lifting cord stopper device 507, the stopper releasing cord 511 is mounted on the cord stopper 509. The stopper releasing cord 511 releases the lifting cord 504 by separating the cord stopper 509 from the cord nozzle 508 resisting the force of the spring 510 in order to allow the slats to descend by its own weight.

In the embodiment shown in the same Figure, the rotating operation rod 512 for revolving the slats is provided and the top end of the rotating operation rod 512 is connected to the rotating shaft 505 through a universal joint. By revolving the rotating operation rod 512, the rotating shaft 5 is revolved to revolve the slats.

After the ends of the lifting cords 4 are introduced horizontally within the head box and passed through the lifting cord stopper device 7, the lifting cords 4 are introduced through the rotating operation rod 12 and extended downward from the rotating operation rod 12.

Thus, the slats are revolved by operating the rotating operation rod 12, and the slats 1 are lifted up or down by the lifting cord 4 extending downward from the rotating operation rod 12. In the horizontal type blind apparatus, three lifting cords 4 are provided.

In the blind apparatus utilizing three or more lifting cords, as compared with the lifting cords which pass near both ends of the slats, a larger load is applied to the lifting cords which pass in the center of the slats by the bottom rail and the slats. Because the lifting cord stopper device fastens all the lifting cords with an equal force by fastening the lifting cords to stop the blind apparatus, the lifting cord passing in the center of the slats, which is loaded with the largest load is likely to slip even when the stopper device fastens the lifting cords. Thus, the lifting cord stopper device sometimes cannot fasten the lifting cord which passes near the center of the slats.

According to the present invention, to solve such disadvantage of the blind apparatus, after the lifting cord disposed in the center is introduced into the head box, the lifting cord is led in a direction opposite to the aforementioned lifting cord stopper device, wound around the direction reversing roller and led to the lifting cord stopper device. Thus, the lifting cord 4 is passed through the guiding roller 13 disposed in the center of the head box, led in a direction opposite to the lifting cord stopper device 7 and wound around the direction reversing roller 14. After this, the lifting cord is led to the lifting cord stopper device 7, introduced through the lifting cord stopper device 7 and led through the rotating operation rod 12.

Reference numeral 15 designates the guiding roller for guiding a lifting cord 4 other than the aforementioned lifting cords.

Figure 4:
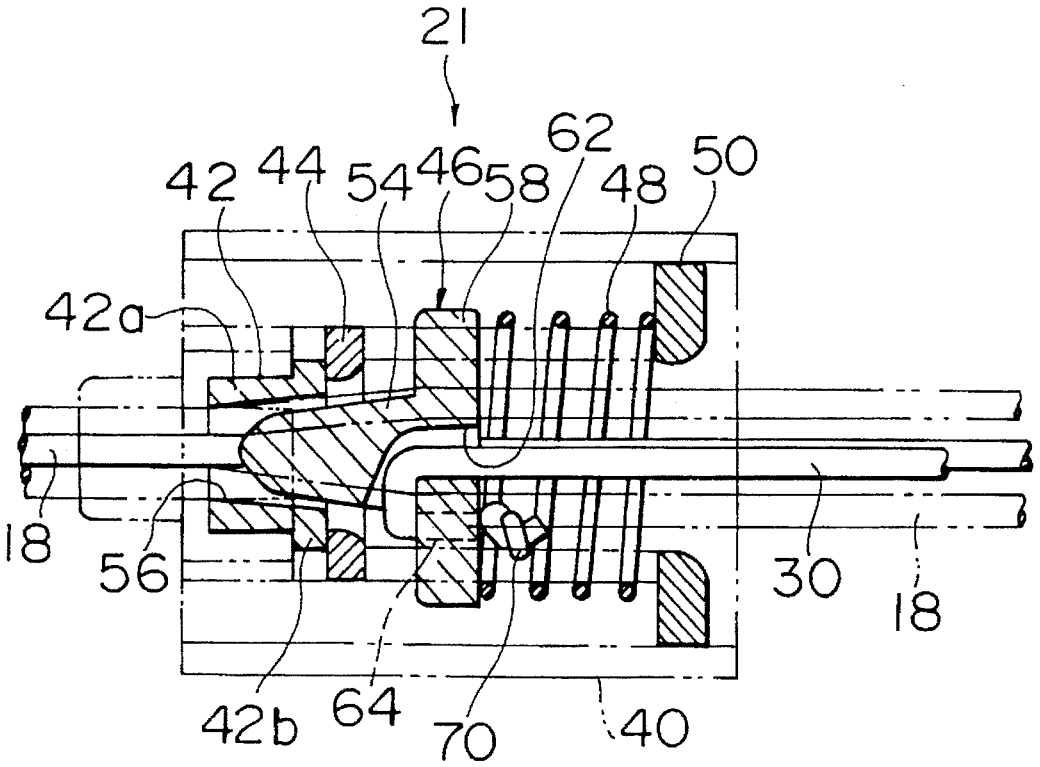
FIG. 4 is a sectional view taken along the lines 4—4.

Because, as shown in FIGS. 3, 4, after the lifting cord 4 is introduced into the head box 2, the lifting cord 4 is inserted into the lifting cord stopper device 7 through two rollers 13, 14, the load A of the slats and the bottom rail, applied to the lifting cord 4 disposed in the center is reduced by the friction resistances B+C of the guiding roller 13 and the direction reversing roller 14, so that the lifting cord stopper device is loaded with the load D. By setting the resistance B obtained by the direction reversing roller 14 so as to be almost the same as a difference between the load A and a load applied to the lifting cord stopper device by means of the lifting cords 4 at the right and left ends of the blind apparatus, it is possible to equalize the loads applied to the lifting cord stopper device by means of the lifting cords, so that the lifting cord stopper device is capable of fastening all the lifting cords securely.

As described above, according to the present invention, a load applied to the lifting cord stopper device by the lifting cord located in the center portion which receives the largest load, of all the lifting cords, is reduced. Consequently, it is possible to prevent the lifting cord stopper device from slipping on the lifting cord stopper device when the lifting cord in the center supports a larger load than the other lifting cords and always maintain the slats horizontally so that the center portions of the slats and the bottom rail do not droop when the slats are descended halfway.

A different embodiment of the present invention will be described with reference to FIGS. 25 to 27. This embodiment features an improved structure for mounting the blind apparatus to, for example, to a window sill. The whole structure of the blind apparatus will not be described since it may be substantially the same as that described before in connection with FIGS. 1 to 6.

In this embodiment, a head box 612 has both longitudinal side edges 636 bent inward as at bends 637 so as to oppose each projects outward from front and lower sides of the lower end of bracket 640, whereby the head box 612 is retained by the bracket 640.

Figure 25:
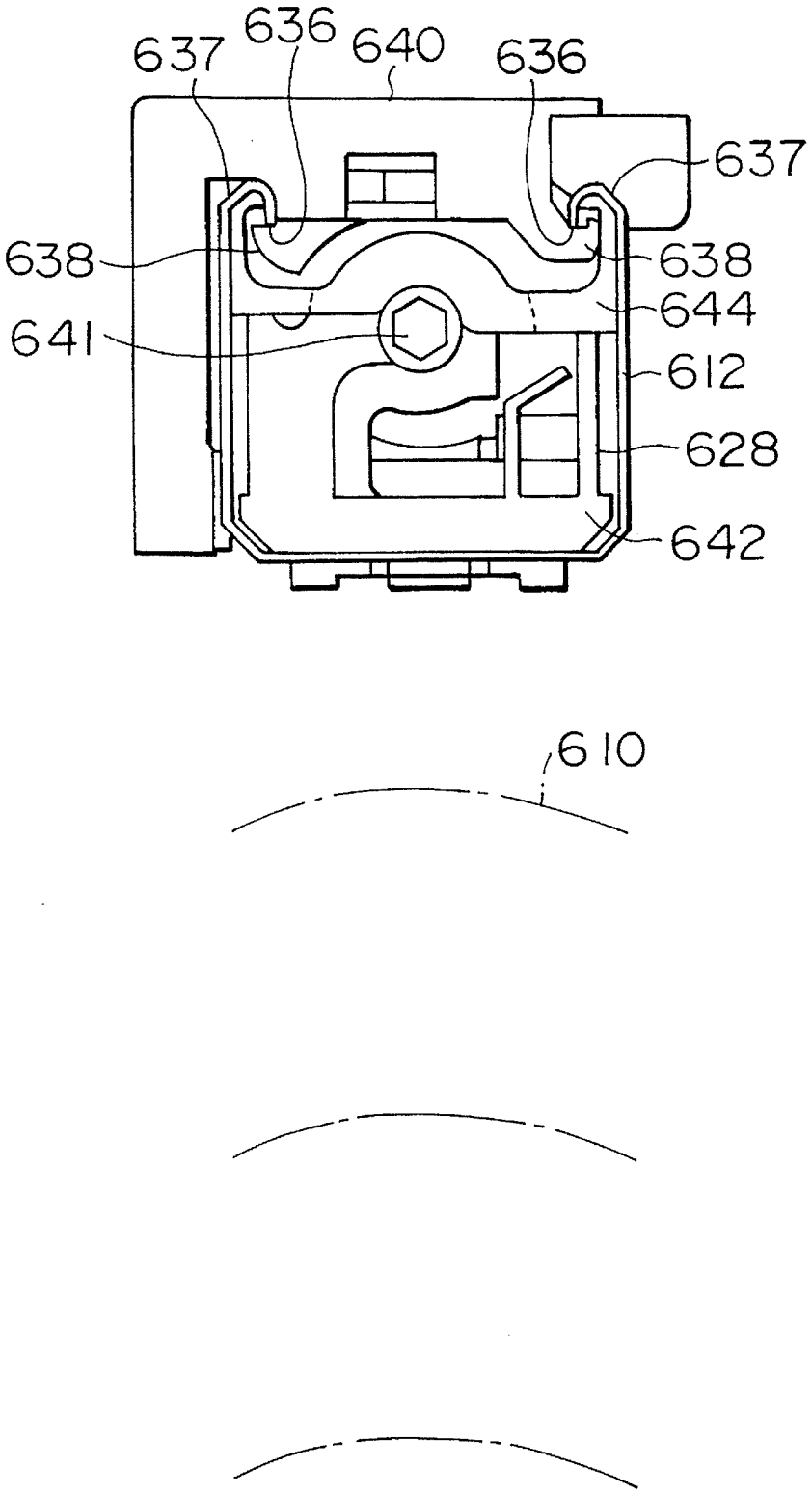
FIG. 25 is an illustration of a critical portion of a different embodiment of the blind apparatus of the present invention, illustrative of a rotary drum mounted in the head box.

FIG. 25 illustrates a rotary drum 628 attached to the head box 612. A drum support 642, which fixes a rotary drum 628 to the head box 612, is disposed such that its lower surface contacts the bottom of the head box 612. The drum support 642 is connected at its upper end to a spacer 644 which has both side walls extended upward along both side walls of the head box 612. The upper end of the spacer 644 projects above the side edges 636 of the head box 612 and is configured in conformity with the bends 637 so as to fit in the latter. The portion of the spacer 644 fitting in the corresponding bend 637 has such a thickness that does not cause this portion to contact the retainer 638. According to this arrangement, it is possible that the bracket 640 catches and retain the side edges 636 of the head box 612 even at the portion where the spacer 644 is provided, through insertion of the retainer 638.

Figure 26:
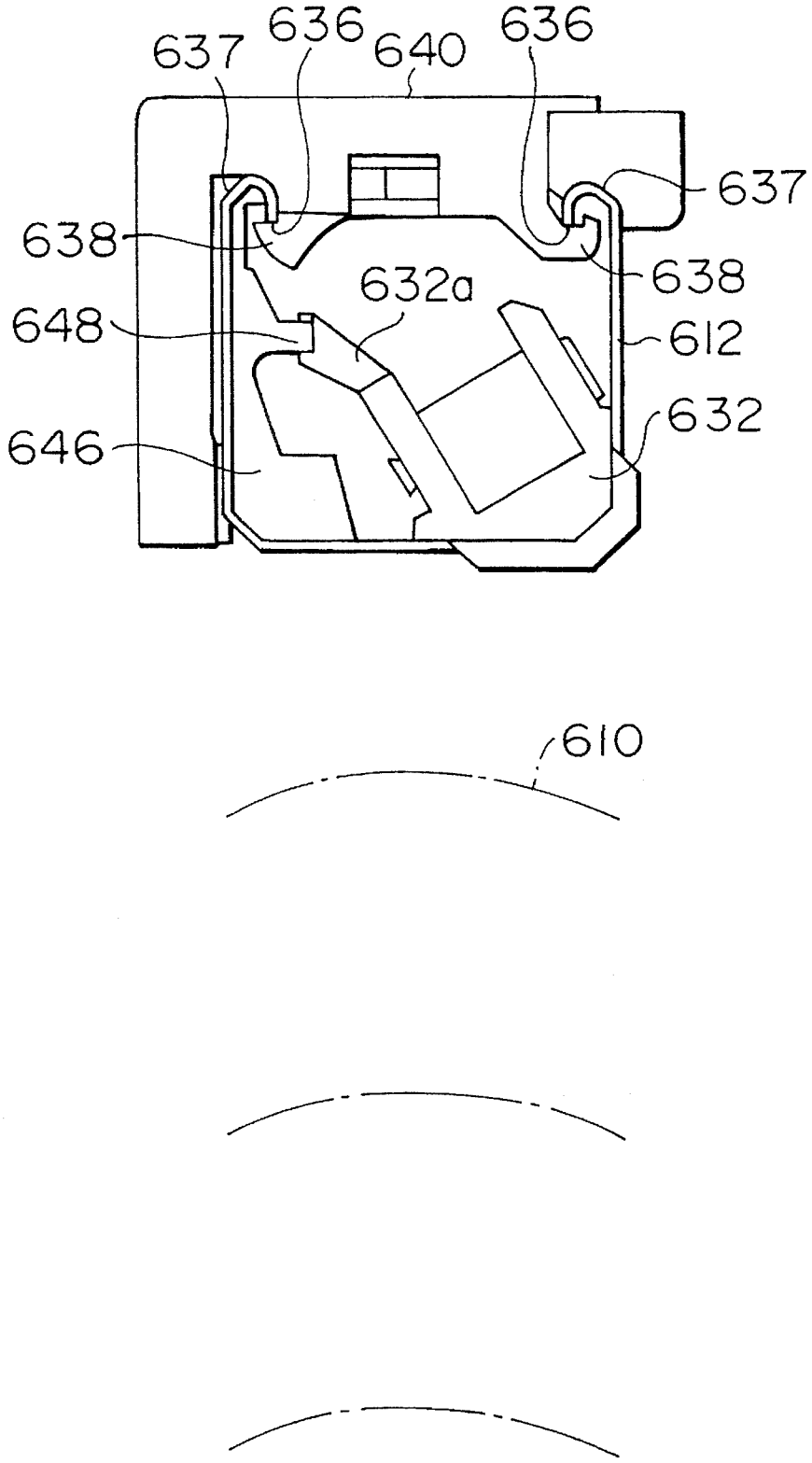
FIG. 26 is an illustration of a stopper mounted in the head box in the embodiment shown in FIG. 25.

FIG. 26 illustrates a stopper 632 secured to the head box 612. The stopper 632 is disposed at front lower part of the head box 612 in contact with both the front side wall and the front part of the bottom wall of the head box 612. The upper end of the portion of the side wall **632*a* behind the stopper 632 is connected to the connecting portion 648 which projects forwardly from a predetermined heightwise portion of the spacer 646, so as to be prevented from moving. The spacer 646 is disposed in a rear part of the head box 612 in contact with both the rear side wall and rear part of the bottom wall of the head box 612. The upper end of the spacer 646 is configured in conformity with the inner configuration of the bend 637 so as to fit in the latter. The portion of the spacer 646 fitting in the bend 637 has such a thickness that does not cause this portion to contact the retainer 638 of the bracket 640. According to this arrangement, the bracket 40 can retain the side edge 636 of the head box 612 even at the portion where the spacer 646 is provided, through insertion of its retainer 638**.

Figure 27:
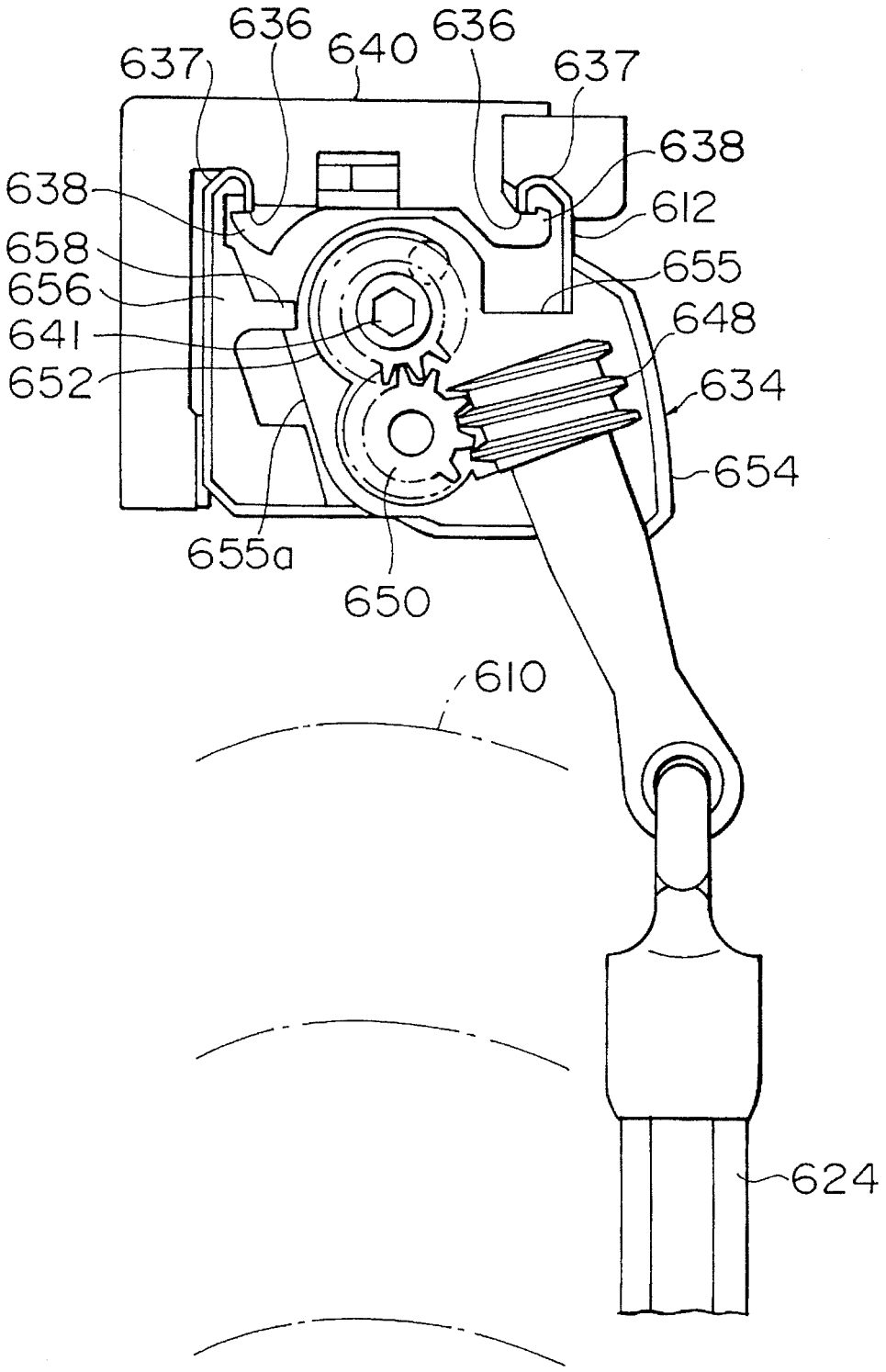
FIG. 27 is an illustration of a tilter attached to the head box in the embodiment shown in FIG. 25.

FIG. 27 illustrates a tilter 634 attached to the head box 612. The tilter 634 has the following components: a worm 648 attached to an end of the rotating operation rod 624 for rotation as a unit with the rod 624; a worm wheel 650 meshing with the worm 648 so as to be rotatingly driven by the latter; a warm wheel 652 meshing with the worm wheel 650 so as to be rotatingly driven by the worm 648; a tilter case 655 projecting from front side wall of the head box 612 to the lower face of the latter and capable of accommodating the worm 648, worm wheel 650 and the worm wheel 652; and a tilter cover 654 which conceals the portion of the tilter case 655 projecting from the front side of the head box 612. The worm wheel 652 is integrally carried by a rotor shaft 641 so as to rotate together with this shaft, thereby transmitting the rotation of this shaft to the rotary drum 628. The portion of the side wall **655*a* behind the tilter case 655 is connected to the connecting portion 658 which projects forward from a predetermined heightwise portion of the spacer 656 so as to be prevented from moving. The spacer 656 is disposed behind the head box 612 in contact with both the rear side wall and the rear part of the bottom surface of the head box 612. The upper end of the spacer 644 projects above the side edges 636 of the head box 612 and is configured in conformity with the bends 637 so as to fit in the latter. The portion of the spacer 644 fitting in the corresponding bend 637 has such a thickness that does not cause this portion to contact the retainer 638. According to this arrangement, it is possible that the bracket 640 catches and retain the side edges 636 of the head box 612 even at the portion where the spacer 644 is provided, through insertion of the retainer 638**.

According to this embodiment, the spacer for fixing the rotary drum, stopper and the tilter inside the head box is made to fit in the bent portions of both side edges of the head box so as not to interfere with the retainers of the bracket. The bracket therefore can retain the side edges of the head box even at portions where the drum, stopper and the tilter are disposed, by insertion of the retainers of the bracket. This enables a worker who attaches the bracket to, for example, a window sill to fix the bracket without paying specific attention to the position of the spacer. Consequently, restriction on the position of the bracket is eliminate to offer a higher efficiency of the work for installing the blind apparatus. In addition, a neat appearance is provided by virtue of the fact that both side edges of the head box are inwardly bent to oppose each other.

A different embodiment of the present invention will be described with reference to FIGS. 28 to 33. This embodiment features an improved construction of a bracket for mounting the blind apparatus to, for example, to a window sill. The whole structure of the blind apparatus will not be described since it may be substantially the same as that described before in connection with FIGS. 1 to 6.

Figure 28:
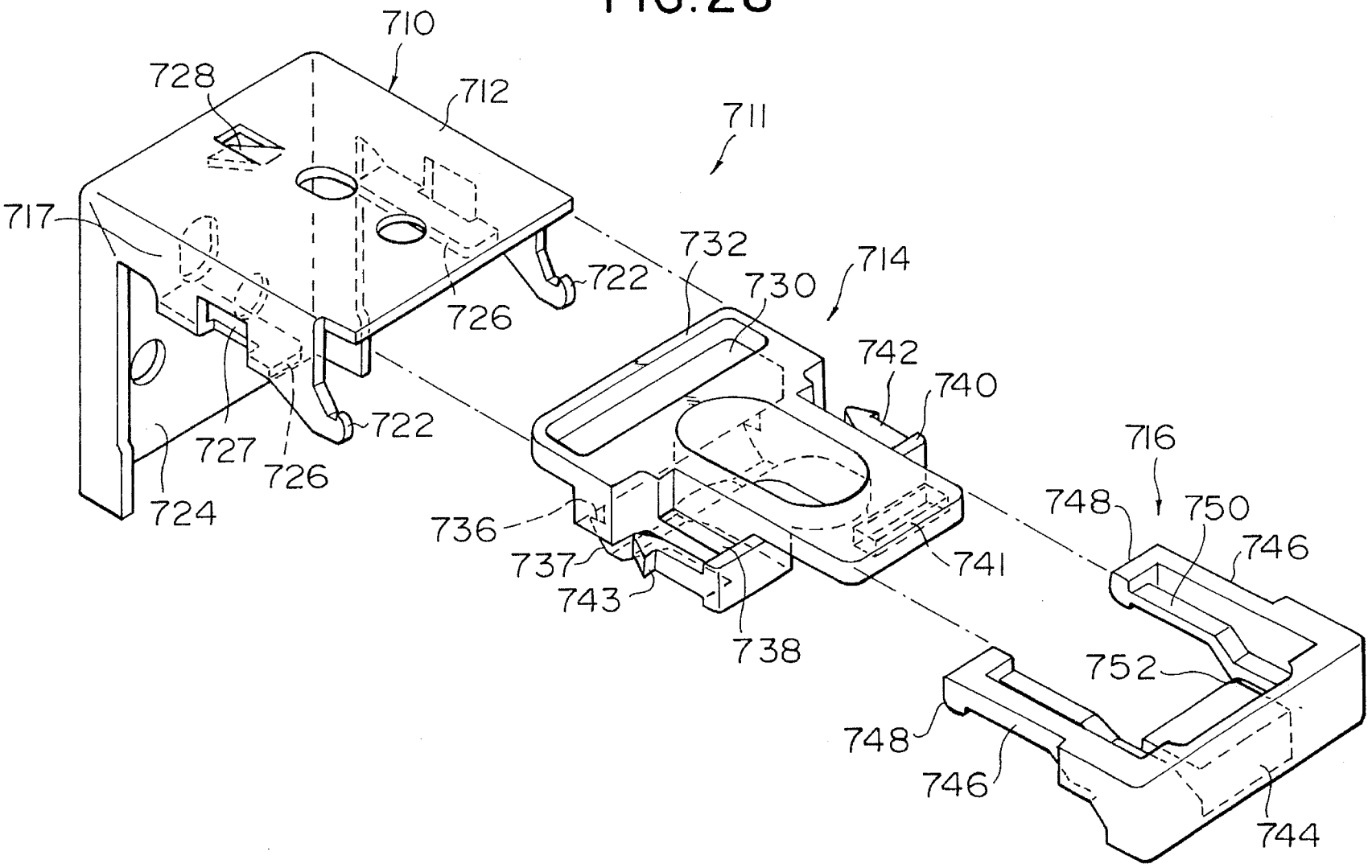
FIG. 28 is an exploded perspective view of a different embodiment of the blind apparatus in accordance with the present invention.

Referring to FIG. 28, a bracket for installing the blind apparatus, denoted by 711, has a substantially L-shaped supporting frame 710 adapted to be fixed to, for example, a wall, a retainer member 714 which is held at the lower side of the horizontal portion 712 of the supporting frame 710 for movement to the left and right as viewed in FIG. 28, and an urging member 16 which is retained by the retainer member 714 for movement to the left and right as viewed in FIG. 28.

The retainer member 714 has side walls 717 of a predetermined width dependent from both side edges of the horizontal portion 712 thereof. A retainer tab 722 having a recess 72 capable of retaining a front flange (one side end) of the head box 718 (see FIG. 29) is formed on the end of each side wall 717. Flat horizontal shelves 726 for slidably supporting the retainer member 714 are formed on the portions of the side walls 717 between the retainer tabs 722 and the base end of the horizontal potion 712 adjacent the vertical portion 724. The portions of the side walls 717 where the shelves 726 are formed are notched as at 727. A portion of the horizontal portion 712 adjacent the vertical portion 724 is cut in a U-shape and the cut portion is bent downward so as to serve as a spring retainer port ion 728.

A spring portion 732 is formed on one end of the retainer member 714. The spring portion 30 has an aperture 730 which receives and retains the spring retainer portion 728 of the supporting frame 710. A retainer projection 736 capable supporting the rear flange (the other side end) of the head box 718 is formed on the lower side of the retainer member 714. A tapered surface 737 is formed under the retainer projection 736. A pair of guide grooves 738 along which the urging member 716 is guided and moved are formed on both lateral sides of the retainer member 714. The guide grooves 738 extend such that their one ends approach the sprig portion 732. A stopper 740 which projects in the heightwise direction of the retainer member 714 is formed near the other ends of the guide grooves 738. Resiliently deformable anchor tabs 742 are formed on the retainer member 714 at portions thereof adjacent the guide grooves 738, so as to be resiliently deflectable in the direction of breadth of the retainer member 714. Each anchor tab 742 has a substantially triangular connecting portion 743 having a bottom side projecting from one side of the anchor tab 742. When the retainer member 714 is inserted into the supporting frame 710, the anchor tabs 742 are deflected inwardly of the retainer member 714 so that the span between both anchor tabs 742 become smaller than that between both side walls 717 of the supporting frame 710. However, as the retainer member 714 is further inserted into the supporting frame 710, the anchor tabs 742 come to face the notches 727 formed in the side walls of the supporting frame 710 so that they restore their original shapes to fit in the notches 727, so as to prevent the retainer member 714 from being withdrawn out of the supporting frame 710. A groove or recess 741 is formed in the lower face of the retainer member 714 at the end of the latter opposite to the spring portion 732.

The urging member 716 has an operating portion 744 by means of which the urging member 716 is operable, and a pair of arms 746 projecting from both ends of the operating portion 744 perpendicularly thereto. Sliding shoe portions 748 formed on the ends of the arms 746 are adapted to be slidably received in the guide grooves 738 so as to be guided by these grooves. Urging tabs 746 are formed on the inner face of the arms 746 over the entire length of these arms 746, so as to oppose each other. Each urging tab 750, extending along the arm 746, has an intermediate inclined portion spaced apart a predetermined distance from the sliding shoe portion 748 so that the level of the urging tab 750 is lowered at a portion of the urging tab 750 remoter from the sliding shoe portion 748. A retaining projection 752 projects downward from the lower side of the lowered portion of the urging tab 750.

A description will now be given of the process for assembly of the bracket 711. The urging member 716 and the retainer member 714 are separately prepared. The sliding shoe portions 748 of the urging member 716 are inserted into the guide grooves 738 of the retainer member 714. Then, the retainer member 714, together with the urging member 716, is moved into the gap between the horizontal portion 712 of the supporting frame 710 and the supporting shelves 726, such that the spring portion 732 is on the leading side as viewed in the direction of insertion. As the retainer member 714 is further moved into the supporting frame 710, the anchor tabs 742 on the retaining member 714 are resiliently deflected inward by being pressed by the side walls 717 of the supporting frame 710, thus allowing the retainer member 714 together with the urging member 716 to slide into the supporting frame 710. As the retainer member 714 is further moved into the supporting frame 710, the anchor tabs 742 come to face the notches 727 so that they restore their original states to fit in the notches 727. In this state, the spring retainer portion 728 of the supporting frame 710 is received in the aperture 730 of the spring portion 732 of the retainer member 714, whereby the retaining member 714 and, hence, the urging member 716 are secured to the supporting frame 710. Any force acting in the direction to withdraw the retainer member 714 from the supporting frame 710 tends to move the retainer member 714 outward against the resilient force of the spring portion 732 of the retainer member 714. This movement, however, is limited since the connecting portions 743 of the anchor tabs 742 abut end edge 717 of the notches 727. The retainer member 714, when relieved from such withdrawing force, is moved deeper into the supporting frame 710 by the resilient force exerted by the spring portion 732. The movement of the urging member 716 outward from the supporting frame 10 is also limited since the sliding hoc portions 748 contact the stoppers 740 on the retainer member 714.

Figure 29:
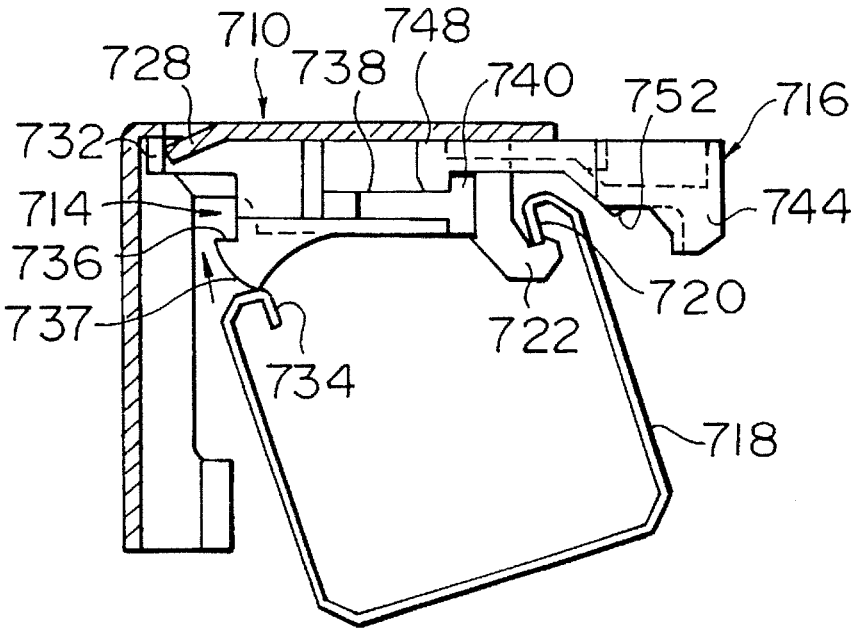
FIG. 29 is an illustration of a critical portion of the embodiment shown in FIG. 28, explanatory of the manner in which the head box is retained at its one side by a supporting frame.
Figure 30:
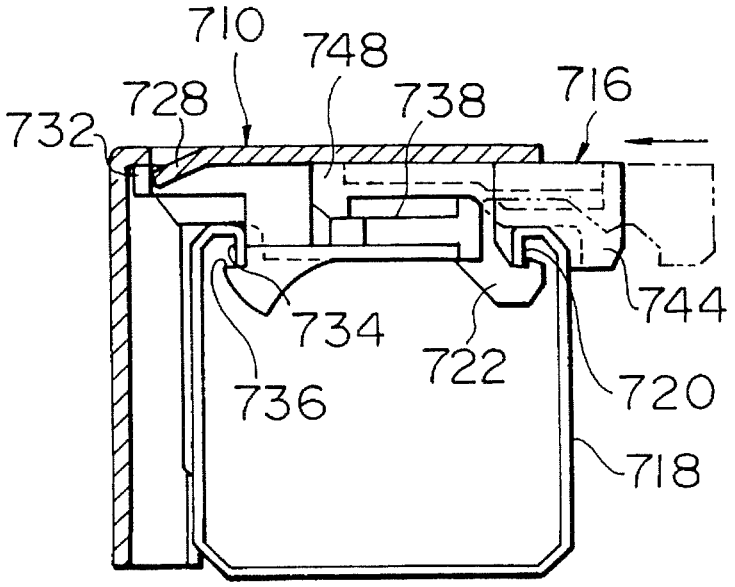
FIG. 30 is an illustration of a critical portion of the embodiment shown in FIG. 28, illustrative of the head box attached to a bracket.
Figure 31:
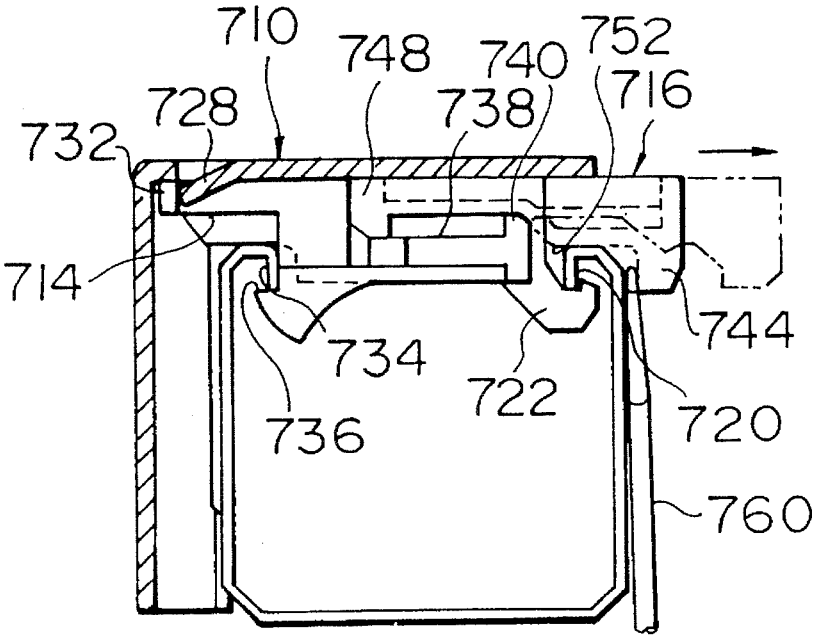
FIG. 31 is an illustration of a critical portion of the embodiment shown in FIG. 28, illustrative of a state in which an urging member has been pulled outward of the supporting frame to enable a head box from the bracket.
Figure 32:
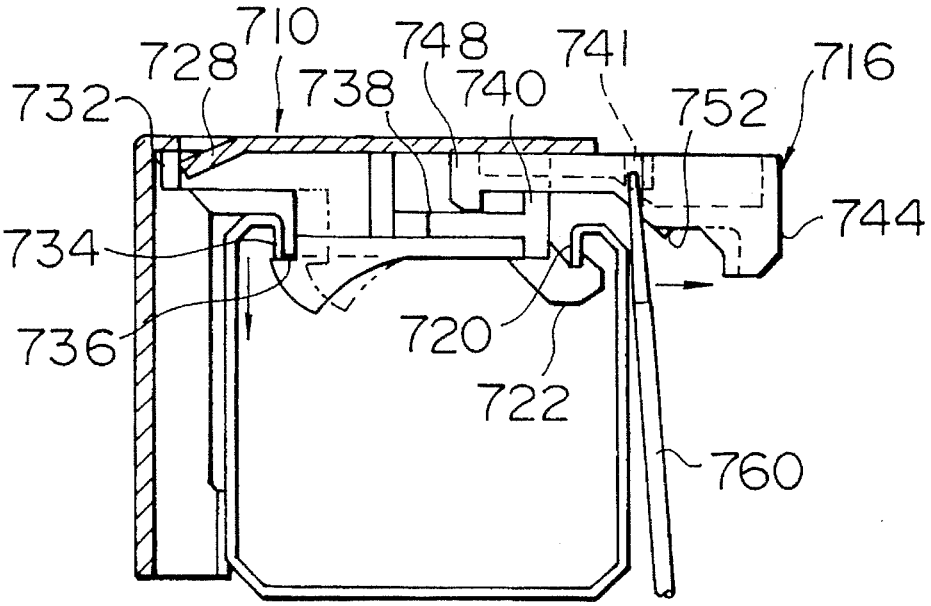
FIG. 32 is an illustration of a critical portion of the embodiment shown in FIG. 28, illustrative of a state in which a retainer member has been pulled outward of the supporting frame to enable the head box from the bracket.

A description will now be given of the process for mounting the head box 718 on the bracket 711. As the first step, the worker holds the operating portion 744 of the urging member 716 and pulls the latter out of the supporting frame 710. Then, the front flange 720 of the head box 718 is brought into engagement with the retaining portions 722 of the supporting frame 710. Then, the head box 718 is moved upward while the rear flange 734 thereof is held in sliding contact with the tapered surface 737. This causes the retainer member 714 to move along the supporting frame 710 to the right as viewed in FIG. 29, so that the rear flange 734 slides on the tapered surface beyond the retaining projection 736 (see FIG. 30). As the rear flange 734 is moved past the retaining projection 736, the force exerted on the retainer member 714 rightward as viewed in FIG. 29 is dismissed, so that the retainer member 714 is allowed to move back to the original position, whereby the rear flange 734 of the head box 718 is retained by the upper face of the retaining projection 736. If the head box 718 has been deviated to the left or right from the right position, the head box position can be adjusted by moving the head box to the left or right. Then, the urging member 716 is pressed towards the vertical portion of the supporting frame 710, from the position shown by one-dot-and-dash line in FIG. 30 so that the retaining projection 752 slides over the front flange 720 of the head box 718 and is received in the space between the front flange 720 and the retaining tab 722, as indicated by solid lines in FIG. 30. Consequently, the front collar 720 of the head box 718 is fixed between the retaining portions 722 of the supporting frame 710 and the operating position 744 and the retaining projection 752 of the urging member 716.

A description will now be given of the method for demounting the head box 718 from the bracket 711. A suitable tool 760 such as a screw driver is inserted into the gap between the lower face of the operating portion 744 of the urging member 716 and the head box 718. The tool 760 is then pulled rightward as viewed in FIG. 31. As a consequence, the retaining projection 752 of the urging member 716 slides over the front flange 720 of the head box 718 to the right side of he front flange 720 as indicated by one-dot-and-dash line in FIG. 31, whereby the front flange 720 is freed. Then, the tool 760 is inserted into the recess 741 in the retainer member 714 and moved to the right as viewed in FIG. 32, so that the retainer member 714 is moved to the right as viewed in FIG. 31 to a position indicated by one-dot-and-dash line in FIG. 31. This causes also the retaining projection 736 to move to the position shown by one-dost-and-dash line, so that the retaining projection 736 no more supports the rear flange 734 of the head box 718 and allows the rear flange 734 to hall downward as viewed in the Figure. Then, the front flange 720 of the head box 718 is pulled to the right as viewed in FIG. 32 while being held in such a manner as to float above the retaining portions 722, so that the front flange 720 clears the retaining portions 722 to allow the head box 718 to come off the bracket 711.

In this embodiment, the head box is temporarily held such that its one side edge is retained by the supporting frame while the other side edge is retained by the retaining member, and then the urging member is pressed into the supporting frame so as to fix the head box. This permits easy mounting and demounting of the head box to and from the bracket. In addition, since the position of the head box can be adjusted to the left and right while the head box is temporarily held, the head box can be moved to the left and right while being supported by the head box and the retainer member, whereby lateral position adjustment of the head box can be done easily.

A different embodiment of the present invention will be described with reference to FIGS. 33 to 35. This embodiment is suitable particularly when the blind apparatus has to be installed in a restricted space such a the space between two opposing sashes of a double-sash structure. The whole structure of the blind apparatus will not be described since it may be substantially the same as that described before in connection with FIGS. 1 to 6.

Figure 33:
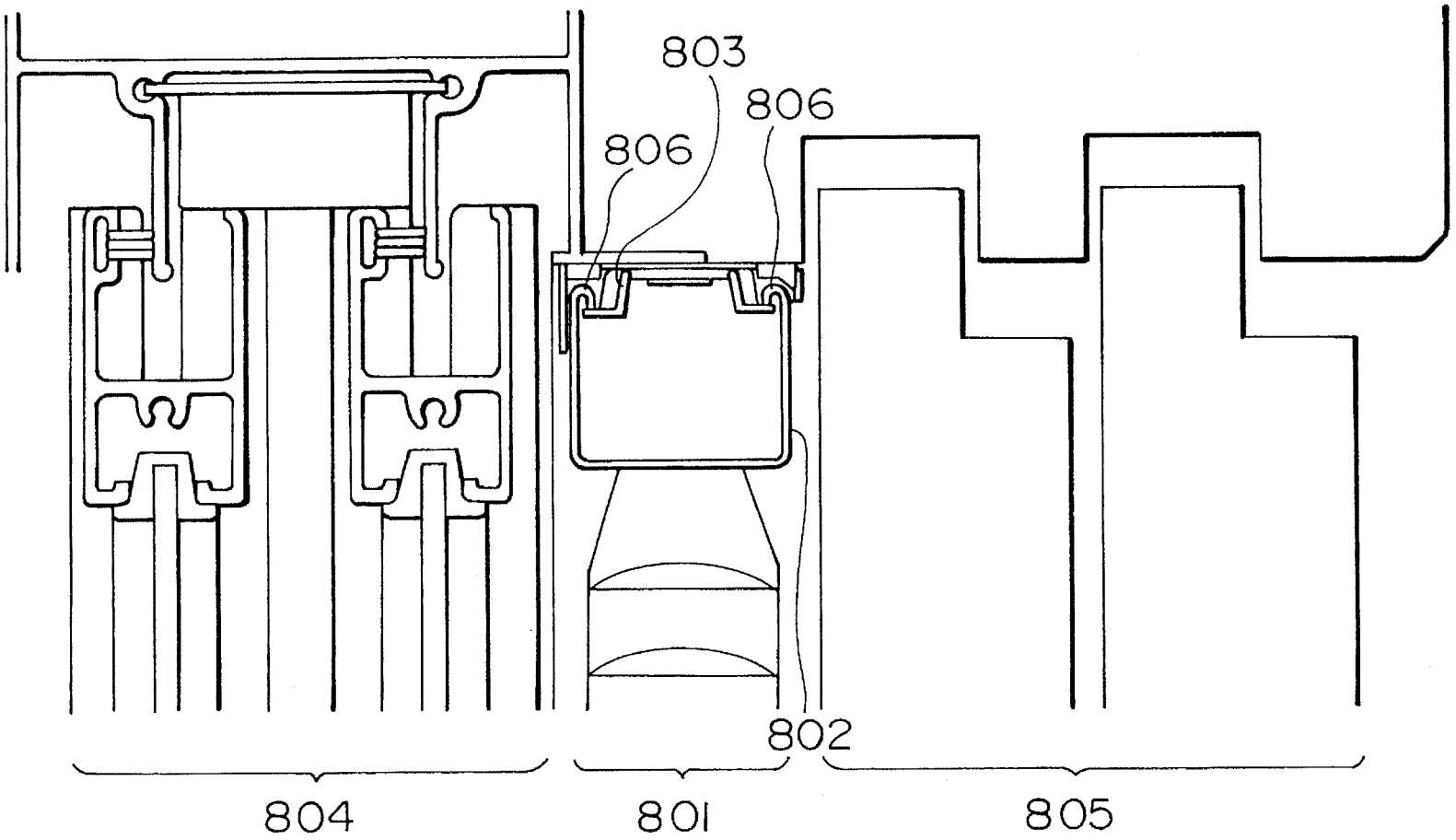
FIG. 33 is an illustration of a different embodiment of the blind apparatus in accordance with the present invention, secured by a bracket having a specific structure.

FIG. 33 shows a blind apparatus 801 installed in a restricted space between a sash 804 which is on the outer side of a room and a shoji (slidable wall consisting of wooden framework and a sheet of paper adhered to the frame work, used in Japanese-style houses), by means of a bracket 803.

Figure 34:
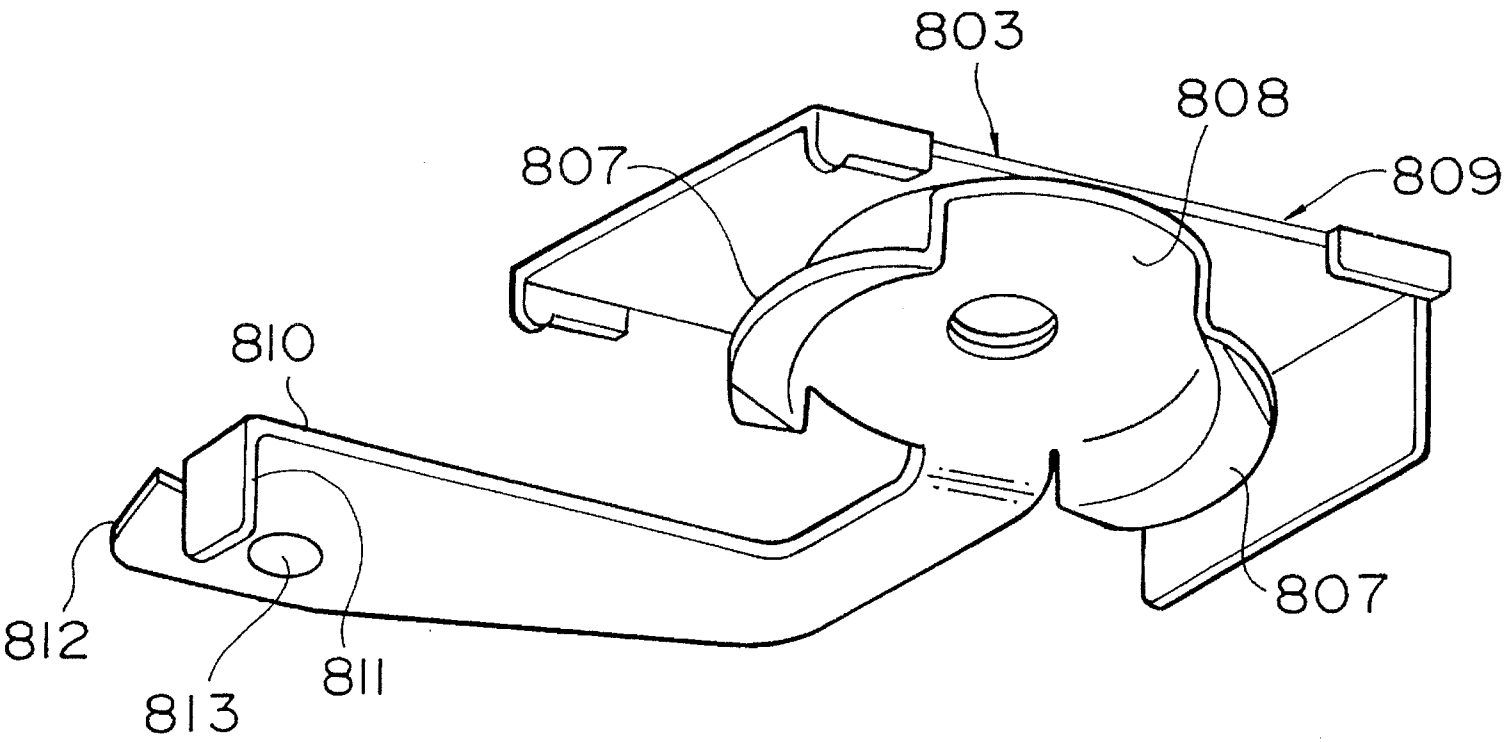
FIG. 34 is a perspective view of the bracket used in the embodiment shown in FIG. 33.
Figure 35:
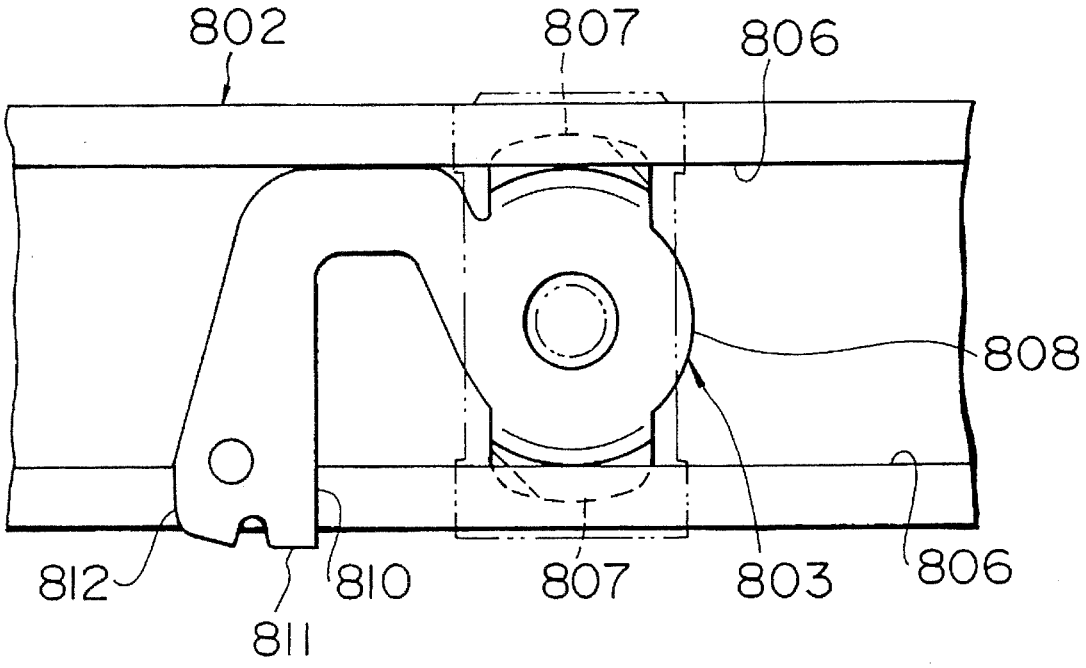
FIG. 35 is a plan view of the head box in the embodiment shown in FIG. 33, fixed by the bracket shown in FIG. 34.

FIG. 34 shows the bracket 803 in perspective view, while FIG. 35 illustrates, in plan, the bracket 803 to which the head box of the blind apparatus 801 is secured.

Figure 23:
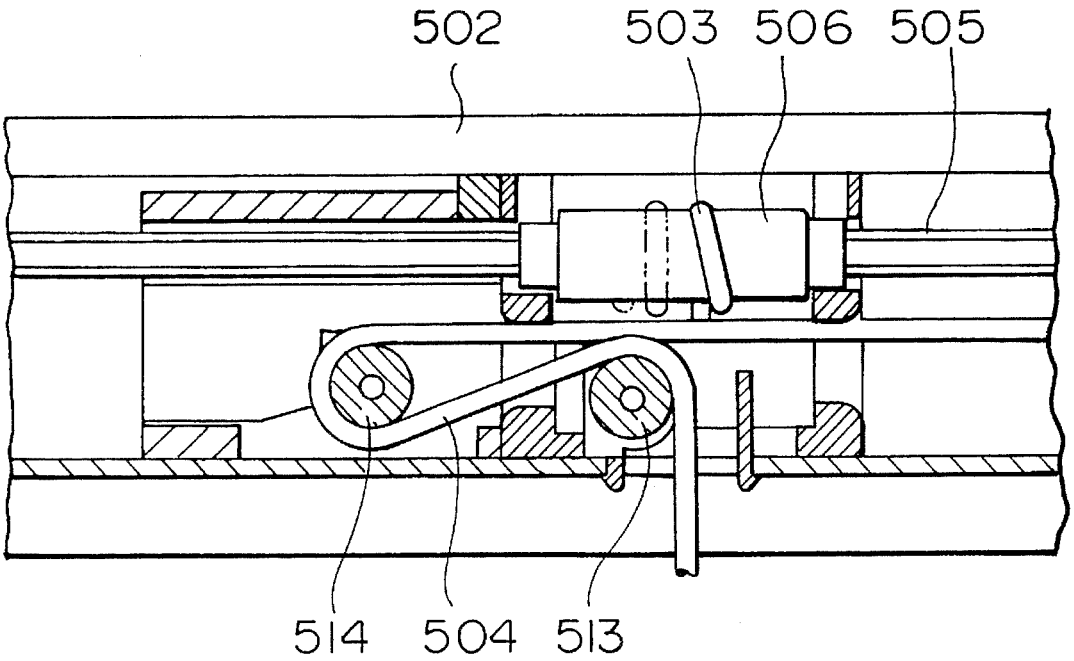
FIG. 23 is an enlarged view of a critical portion of the blind apparatus shown in FIG. 21.
Figure 24:
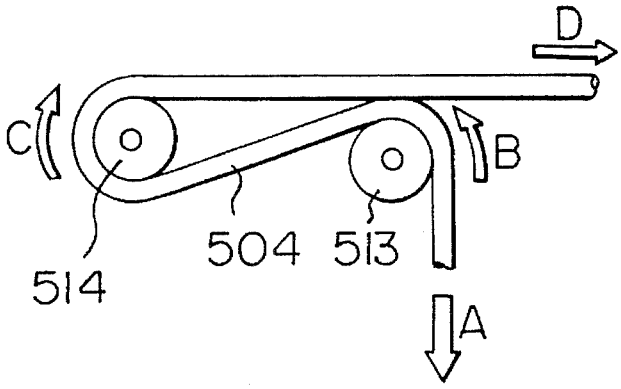
FIG. 24 is an illustration of a manner in which lifting cords are guided in the blind apparatus shown in FIG. 21.

The bracket 801 has a retainer member 808 having a pair of retaining portions 807 formed integrally thereof and adapted to engage with engaging flanges formed to project inward from upper end edges of a head box 802, and a supporting member 809 which support the retainer member 808 in such a manner as to allow the retainer member 808 to rotate within a horizontal plane between a head box engaging position where the above-mentioned retaining portions engage with the engaging flanges 806 of the head box 802 an a head box releasing position where the retaining portions 807 are disengaged from the engaging flanges 806, the supporting member 809 being adapted to be fixed in the aforementioned restricted space. Thus, the supporting member 809 is disposed between the sash 804 and the shoji 805 as shown in FIG. 23.

The retainer member 808 has an operating lever 810 formed integrally therewith and rotatable manually relative to the supporting member 809 in a horizontal plane. The operating lever 810 is provided at its front end with a bent portion 811 which abuts a side surface of the head box 802 when the retainer member 808 is in the head box retaining position, and a release preventing portion 812 which is formed on the leading side of the operating lever as viewed in the direction of rotation for engagement, the release preventing portion 812 projecting by a height substantially equal to the height of projection of the bent portion. The release preventing portion 812 serves to prevent the operating lever from being rotated to the head box release position even when the front end of the operating lever is contacted by the sash or the shoji which is at the outer or inner side of the blind during opening or closing of the sash or the shoji.

Numeral 813 designates a stopper which serves to stop the operating lever 810 at the head box stop position.

Thus, in the illustrated embodiment, the bracket 803 has the operating lever, the bent portion formed by downwardly bending the front ed portion of the operating lever, and release preventing portion which is formed at the leading side of the bent portion as viewed in the direction of rotation of the operating lever for engagement, by a height substantially the same as the height of projection of the bent portion.

When the front end portion of the operating lever is accidentally contacted by, for example, the shoji which jolts during opening or closing so that a force is applied to the operating lever in the disengaging direction, the force exerted by the shoji is diverted by the release preventing portion which is slanted in the horizontal direction, so that the shoji can be further moved without causing the bracket to be disengaged from the head box.

Thus, according to the invention of this application, the state of the bracket can be switched between a state in which it retains the head box and a state in which it releases the head box, by a mere rotation of the operating lever. When the bracket is in the engaging position, the amount of projection of the operating lever is minimum, i.e., the width of the bracket as measured in the direction perpendicular to the head box is reduced to the minimum value. The front end of the operating lever, projecting beyond the front side of the head box is bent downward, and the release preventing portion is formed to extend within a horizontal plane so as to incline towards the inner side of the head box, at the leading side of the downward bend as viewed in the direction in which the operating lever is rotated to disengage the head box. The release preventing portion serves to prevent undesirable release of the head box from the bracket which otherwise may be caused due to jolt of the sash or shoji, thereby preventing accidental drop of the head box.

A different embodiment of the present invention will be described with reference to FIG. 36 to 38. This embodiment employs a reduced number of operating members such as cords so as to provide a neat appearance of the blind apparatus. The whole structure of the blind apparatus will not be described since it may be substantially the same as that described before in connection with FIGS. 1 to 6.

Figure 36:
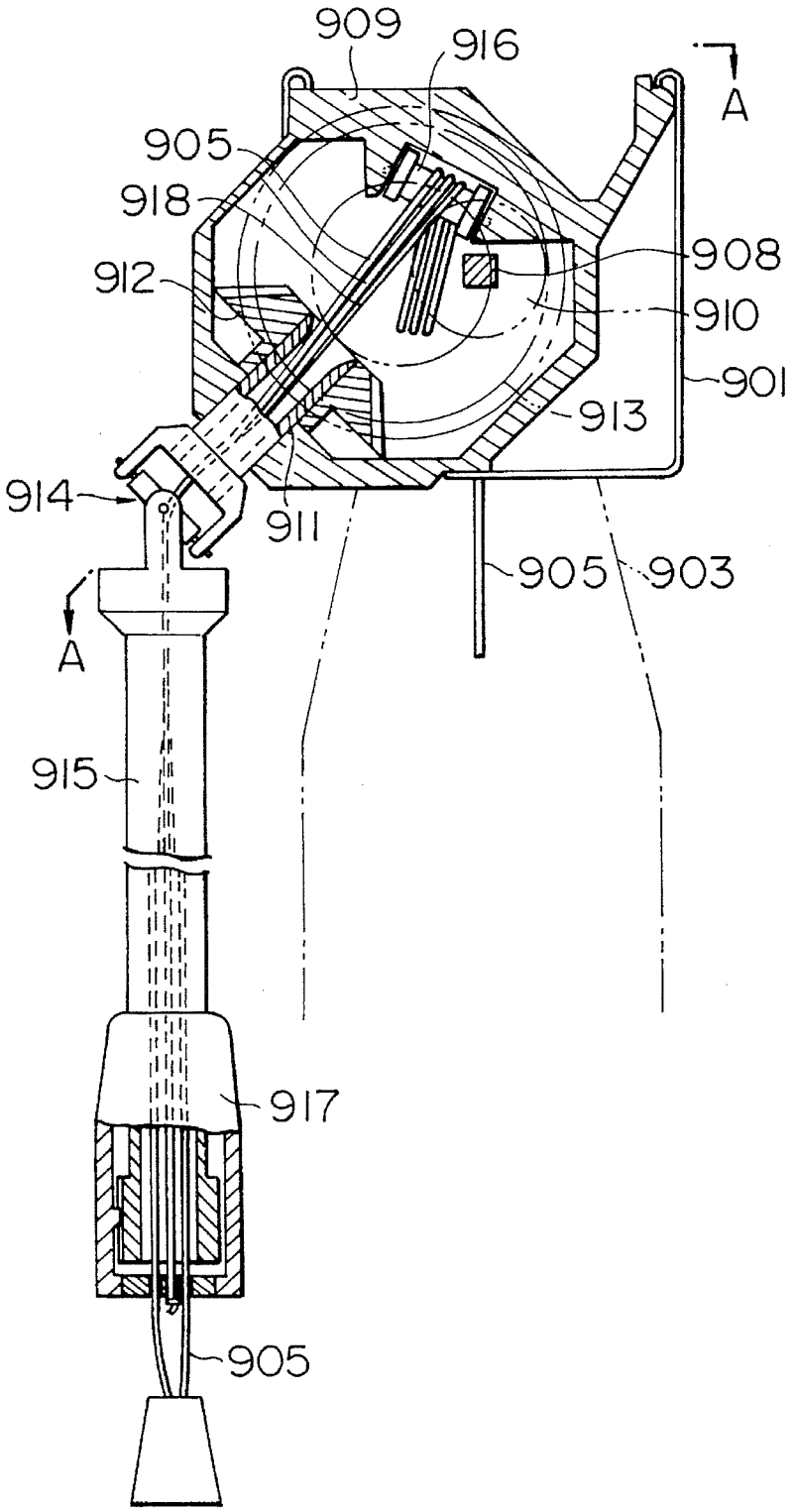
FIG. 36 is a sectional view of a tilt mechanism in a different embodiment of the blind apparatus in accordance with the present invention.
Figure 37:
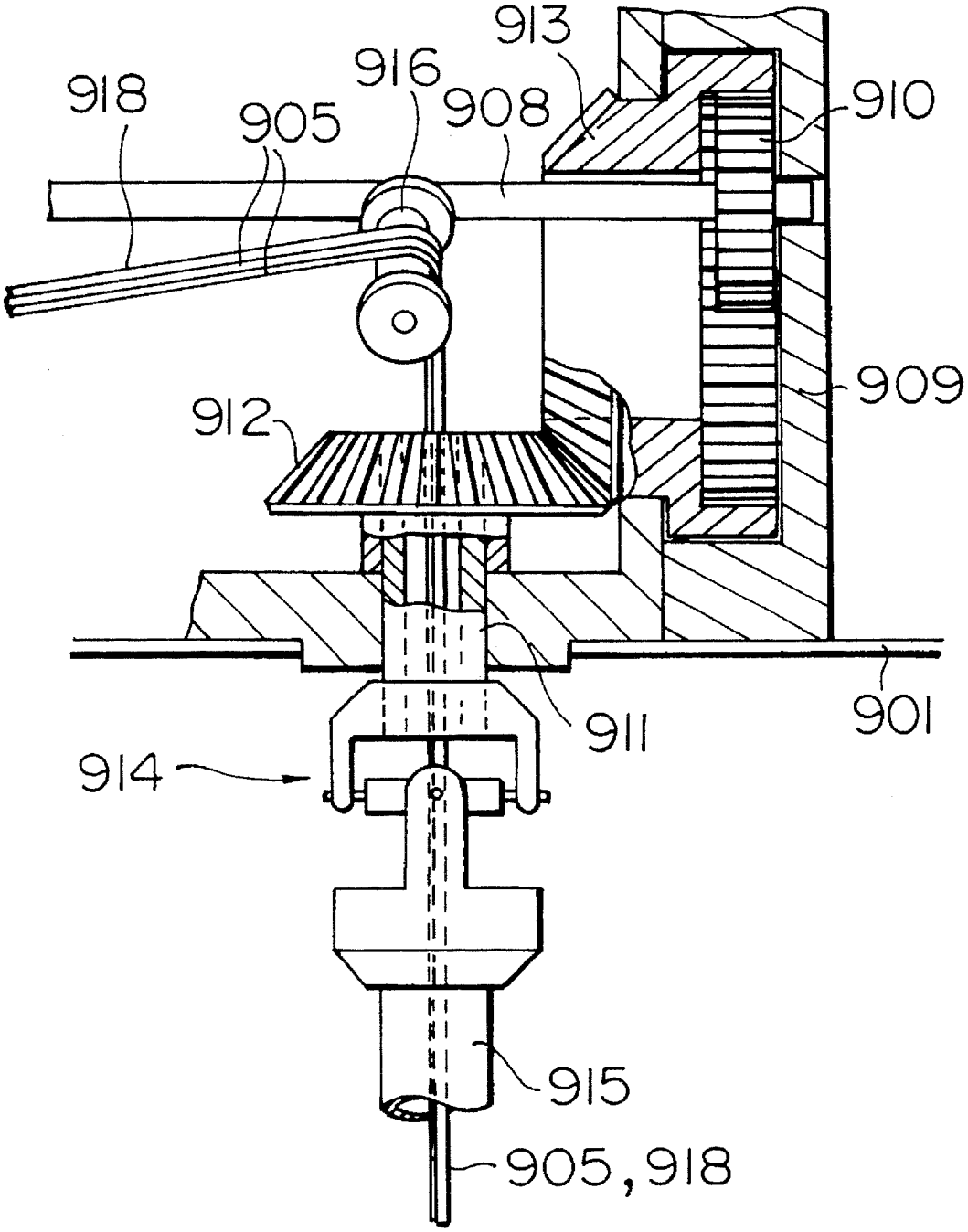
FIG. 37 is a sectional view taken along the line A—A of FIG. 36.
Figure 38:
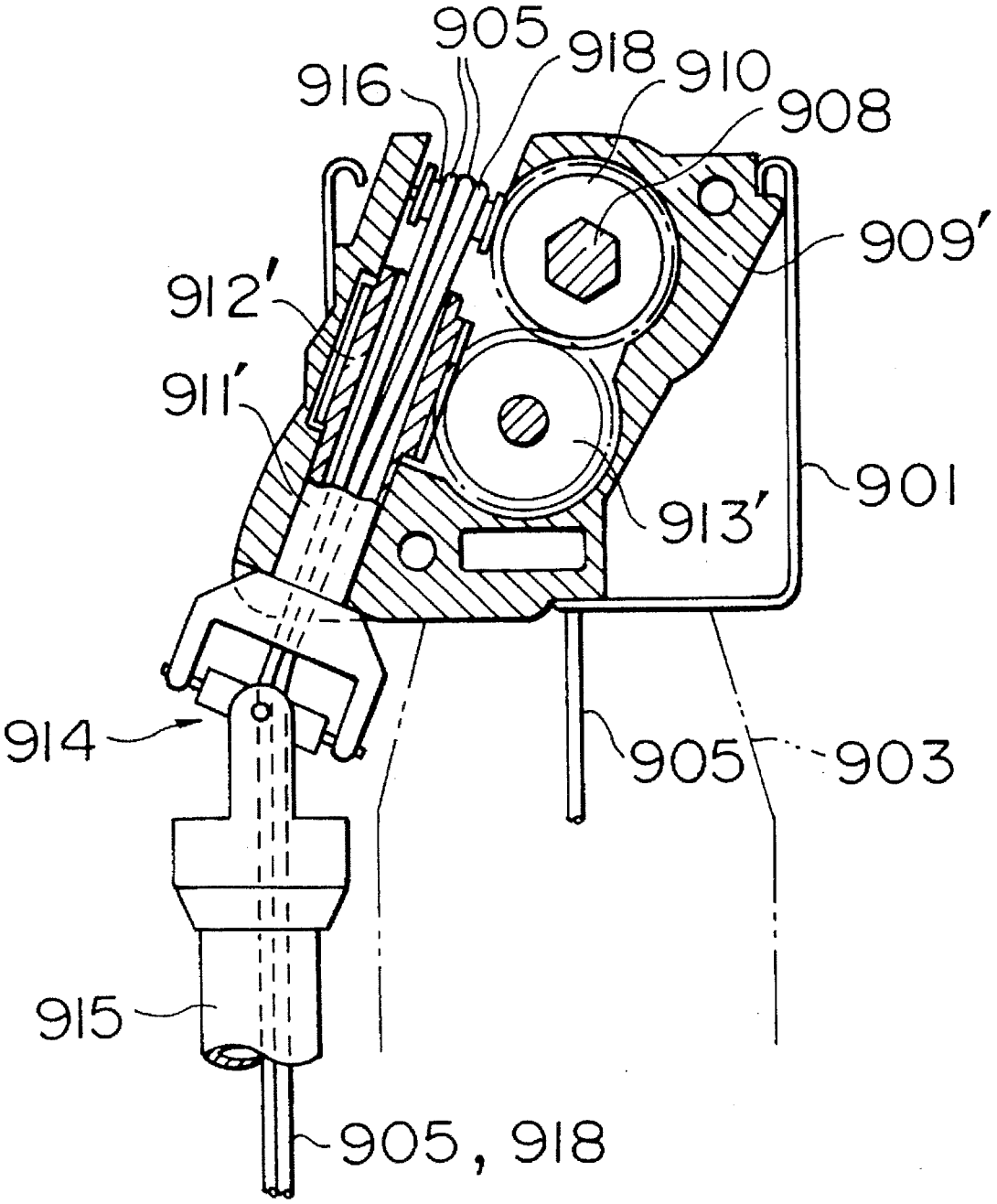
FIG. 38 is a sectional view of a modification of the tilt mechanism shown in FIG. 36.

Referring to FIGS. 36 to 38, a lifting cord 905 extends downward from a head box 901 through holes formed in slats so as to be connected at its lower end to a bottom rail 904. The cord 905 is turned 90° around a turning roller (not shown) in the head box 901 and extends along the head box 901 and emerges from the head box 901 at a portion of the latter near one longitudinal end of the head box 901. The cord 905 is then extended downward through a hollow of a tilt operation lever 906. A clip 907 is connected to the other end of the cord 905.

FIGS. 36 and 37 are sectional views showing the portion of this embodiment around the end of the head box 901 from which the cord 905 is extracted. A tilt rotation shaft 908 is rotatably journaled in the head box 901 so as to extend in the longitudinal direction of the head box 901 and so as to be able to tilt the ladder cord 903 in a manner known per se for the purpose of adjusting the light coming through the gaps between slats. Numeral 909 indicates a case which is fixed to the head box 901, while 910 indicates a gear which is fixed to the tilt rotation shaft 908. The ladder cord 903 is connected at its one end to the tilt rotation shaft 908.

Numeral 911 designates a rotary shaft having a hollow cylindrical portion and mounted in a lower portion of the case 909. A bevel gear 912 journaled inside the head box engages with an intermediate gear 913 which is rotatably supported in the bracket. The intermediate gear 913 is internally toothed to engage with the gear 910 fixed to the tilt rotation shaft 908. Due to the presence of the intermediate gear, the axes of the rotary shaft 911 and the tilt rotation shaft 908 are twisted with respect to each other. The outer end of the rotary shaft 901 projecting outward from the head box is coupled to a hollow cylindrical tilt operating rod 915 through a universal joint 914.

Numeral 916 designates a turning roll which is rotatably supported in the case 909 such that the axis of this roll is on the extension of the axis of the above-mentioned rotary shaft 911. The turning roll 916 serves to turn the lifting cord 905 extending through the head box such that the cord 905 is threaded through the hollows of the bevel gear 912, rotary shaft 911 and the tilt operation rod 915. In this embodiment, the turning roll 916 is spaced as much as possible from the universal joint 914 so as to prevent entanglement of the cord 905 at both sides of the roll 916. More specifically, the turning roll 916 is disposed at an upper part of the head box, such that the axis of the turning roll 916 is inclined both to the extension of he head box 901 and the axis of the bevel gar 912.

Although not shown, the illustrated embodiment may employ a stationary roller and a movable knurled roller which are disposed at predetermined positions in the head box 901 so as to nip the lifting cord 905 therebetween. The knurled roller may be movable between a position where it restrains the lifting cord 905 from moving and a position where it permits the lifting cord 905 to move freely. A switching mechanism may be provided to forcibly switch the knurled roller between these two positions. Such a switching mechanism may be operated by means of an operation cord 918 which together with the lifting cord 905 turns around the roll 916 and extracted to the exterior through the tilt operation rod 915. A knob 917 connected to the lower end of the tilt operation rod 915 as illustrated in FIG. 36 may be used as a member for operating the cod for activating the above-mentioned switching mechanism. For example, the knob 917 is mounted in such a manner as to be movable up and down relative to the tit operation rod 915 so that it dismisses the movement of the lifting cord when it is pulled downward.

According to the described construction, the turning roll 916 for guiding the lifting cords 905 into the bevel gear 912 and the hollow of the tilt operation rod 915 is disposed at an upper portion of the space inside the head box, at a position which is substantially on the extension of the bevel gear 912 and at level above that of the tilt rotary shaft 908. Therefore, lifting cords can have sufficient margin at their portions on both sides of the turning roll 916, so that entanglement tendency of the cords is suppressed to ensure smooth movement of the cords.

When a cord stopping device inside the head box is provided, the cord 918 for operating such a stopping device can be extended together with the lifting cords 905 via the turning roll 916 and through the hollow of the tilt operation rod 915. Entanglement of the cords also is suppressed in this case, thus improving operability of these cords. In addition, the problem of enlargement of the tilt operation rod, which hitherto has been encountered with conventional apparatus, can be eliminated.

FIG. 38 shows a modification of the embodiment shown in FIGS. 36 and 37. This modification has a construction substantially the same as that of the embodiment of FIGS. 36 and 37 except for the constructions of the bracket, rotary shaft, bevel gar and the intermediate gear. More specifically, in this modification, the gear fixed to the rotary shaft 911' is an axially elongated worm gear 912' and an intermediate gear 913' as a drum is held in engagement with this worm gear 912'.

A space is available in the head box for accommodating a long gear on the tilt operation rod. This modification, therefore, offers an advantage in that the breadth of the head box 901 is reduced, in addition to the above-described advantages offered by the embodiment shown in FIGS. 36 and 37.

According to the invention, a cord turning member such as the turning roll for guiding the lifting cords into the hollow of the gear and then into the hollow of the tilt operation rod is disposed at an upper portion of the space inside the head box substantially on the extension of the hollow of the gear and at a level above the tilt rotary shaft, so as to avoid any interference between the lifting cords and the tilt rotation shaft, thus eliminating entanglement of plural lifting cords to ensure smooth movement of the lifting cords.

In a preferred form of this embodiment, a stopping device for stopping the lifting cords is disposed in the head box. In such a case, a cord for operating this stopping device may be extended together with the lifting cords via the turning roll and through he tilt operating rod, with reduced risk of the cords, thus improving reliability of operation.

When the gear on the tilt operation rod is designed in the form of a long worm gear, the width of he head box can be reduced advantageously.

Although the invention has been described through its specific forms, it is to be understood that the described embodiments are only illustrative and various changes and modifications may be imparted thereto without departing from the scope of the invention which is limited solely by the appended claims.

What is claimed is:

1. A blind apparatus, comprising:

a head box having opposite longitudinal side edges;

a bracket for mounting said head box on a wall or the like and having means for retaining said opposite longitudinal side edges;

a bottom rail vertically spaced from said head box;

a plurality of vertically spaced slats extending substantially parallel to each other in a space between said head box and said bottom rail;

a plurality of ladder cords extending between said head box and said bottom rail for supporting said plurality of slats;

a rotary drum located inside said head box, said ladder cords being connected, at one end thereof, to said rotary drum for being wound on and rewound from said rotary drum upon rotation of said drum in opposite directions;

tilter means for tilting of said plurality of seats and including:

a tilter input shaft extending downward at one end of said head box;

a tilter disposed in said head box for transmitting rotation of said tilter input shaft to said rotary drum;

a hollow rotating operation rod coupled to said tilter input shaft for rotating same, a universal joint for coupling said hollow rotating operation rod to said tilter input shaft, and a hollow grip provided at a lower end of said operation rod for rotating same;

lifting cords connected at one end thereof to said bottom rail and extending through holes formed in said plurality of slats for lifting a blind formed by said plurality of slats, said lifting cords extending through said head box and then through an interior of said hollow rotating operation rod and said hollow grip, and said lifting cords having another end thereof extending from a lower end of said hollow grip;

a stopper device located in said head box for preventing said lifting cords from moving; and a stopper device releasing cord connected at one end thereof to said stopper device and extending through the interior of said hollow rotating operation rod and said hollow grip;

wherein said stopper device includes:

a shopper case fixed to said head box and opened at an upper end thereof, a cord nozzle provided at one end of said stopper case, means for preventing movement of said cord nozzle in a longitudinal direction, a cord stopper provided on said stopper case, means for enabling movement of said cord stopper in the longitudinal direction and for preventing rotation of said cord stopper, and a spring for biasing said cord stopper toward said cord nozzle; and wherein said cord stopper includes:

a bottom portion fitted to said stopper case and having a bore through which said lifting cords extend, a conical end projecting from said bottom portion and cooperating with said cord nozzle for clamping the lifting cord therebetween, a first insertion hole extending from said bottom portion to an outer peripheral surface of said conical end near an apex of said conical end, and a second insertion hole formed in said bottom portion radially outwardly of said first insertion hole, said stopper release cord extending through said first insertion hole, said outer peripheral surface of said conical end, and then through said second insertion hole so as to be fastened to said cord stopper at a side of said bottom portion opposite said conical end.

2. A blind apparatus according to claim 1, wherein said hollow grip is adapted to move up and down relative to said operation rod for releasing said stopper device, said blind apparatus further comprising a twining preventive ring connected to said hollow grip for vertical linear movement therewith and for rotational movement relative thereto, said stopper device being released by said stopper release cord upon vertical linear and rotational movements of said twining preventive ring.

3. A blind apparatus according to claim 1, wherein said universal joint comprises:

a first bifurcated piece projecting from an end of said tilter input shaft adjacent to said operation rod and having a pair of opposed branches having each a conical, tapering outwardly, first pin receiving hole;

a second bifurcated piece projecting from an end of said operation rod adjacent to said tilter input shaft and having a pair of opposed branches having each a second pin receiving hole; and a hollow piece for interconnecting said tilter input shaft and said operation rod for joint rotation with each other with a possibility of changing angular relationship therebetween, said interconnecting hollow piece having first and second connecting pins rotatably received in said first and second holes, respectively, and said first connecting pins having heads with portions protruding in a direction of an axis of said interconnecting piece.

4. A blind apparatus according to claim 3, wherein said first pins have, opposite said protruding portions slant surfaces progressively approaching axes of respective first connecting pins along lengths of said first connecting pins.

5. A blind apparatus according to claim 1, wherein said tilter device further comprises a torque applying element which provides for operation of said tilter input shaft with a larger starting torque and a smaller operational torque.

6. A blind apparatus according to claim 5, wherein said torque applying element comprises an elastic member having opposite ends deflected slightly outwardly.

7. A blind apparatus according to claim 6, wherein said elastic member is formed as a U-shaped spring.

8. A blind apparatus according to claim 1, wherein said operation rod comprises a pair of axially spaced hooks for holding each a lifting rod wound thereon, each hook having a linking portion attached to said operation rod and a T-shaped protruding portion having two wing portions projecting laterally from said linking portion, one of said two wing portions and said connecting portion forming a groove-shaped clamping portion, the clamping portions of said pair of hooks opposing each other.

9. A blind apparatus according to claim 1, wherein said lifting cords comprises at least three cords, and wherein said blind apparatus further comprises first and second guide rollers located in said head box for, respectively, keeping a central of said three cords, after it is introduced into said head box, away from said stopper device and for introducing it into said stopper device.

10. A blind apparatus according to claim 1, wherein said head box has sidewalls having opposite inwardly bent upper end edges forming a mounting surface, wherein said blind apparatus further comprises spaces for fixing said rotary drum and said stopper device in said head box at a level below a level of a lower end of retaining portions of said mounting bracket, said spacers having a shape corresponding to configurations of said bent upper end edges, so that upper ends of said spacers do not contact said retaining portions of said mounting bracket.

11. A blind apparatus according to claim 1, wherein said mounting bracket comprises:

a supporting frame having a vertical portion for securing said supporting frame to a wall or the like, and a horizontal portion extending transversely to said vertical portion and including a tab for retaining one said of said head box;

a retainer member received in said supporting frame and having a projection for retaining another side of said head box, said horizontal portion of said supporting frame having support shelves for supporting said retainer member for movement in and out of said supporting frame; and an urging member retained by said retainer member for securing said head box in said mounting bracket;

said retainer member including a spring portion for biasing said retainer member into said supporting frame, guide grooves for guiding said urging member during movement of said urging member in and out of said supporting frame, said guide grooves having at ends thereof a retaining portion for restricting movement of said urging member, and anchor tabs for restricting movement of said retainer member out of said supporting frame;

said urging member including an operating portion for moving said urging member, a sliding part received in said guide grooves, a resiliently deflectable urging tab connected between said operating portion and said sliding part, and a retaining projection formed on a lower portion of said urging member for being fitted in a space between said retaining portion of said horizontal portion and said one side of said head box.

12. A blind apparatus according to claim 1, wherein said mounting bracket comprises:

a rotary member having retaining portions on opposite lateral sides thereof; and a supporting member for supporting said rotary member for rotation in horizontal plane between a retaining position, in which said retaining portions retain both side edges of said head box, and a release position, in which said retaining portions of said rotary member release said side edges of said head box, said supporting member being fixed in a restricted space between a pair of shield members movable between closed and open positions;

said rotary member including an operating lever formed integrally therewith for rotating said rotary member in a horizontal plane relative to said supporting member;

said operating lever having a front end with a bent portion which abuts a side wall of said head box when said rotary member is in the head box retaining position, and a release preventing portion which projects by a substantially same amount as an amount of projection of said bent portion, at a leading side of said bent portion as viewed in a direction of rotation of said operating lever towards said head box retaining position;

whereby undesirable rotation of said operation lever into said head box release position, due to eventual contact of said operating lever with one of said shield members, during opening or closing of said shield members, is prevented.

* * * * *